US011529279B2

(12) United States Patent
Maier

(10) Patent No.: US 11,529,279 B2
(45) Date of Patent: Dec. 20, 2022

(54) MEDICAL DEVICE FOR TREATING CARPAL TUNNEL AND DE QUERVAIN'S SYNDROMES

(71) Applicant: Anodyne Systems LLC, Flowood, MS (US)

(72) Inventor: Joel Elisha Maier, Flowood, MS (US)

(73) Assignee: Anodyne Systems LLC, Flowood, MS (US)

( * ) Notice: Subject to any disclaimer, the term of this patent is extended or adjusted under 35 U.S.C. 154(b) by 719 days.

(21) Appl. No.: 16/390,924

(22) Filed: Apr. 22, 2019

(65) Prior Publication Data

US 2019/0321249 A1 Oct. 24, 2019

Related U.S. Application Data

(60) Provisional application No. 62/697,765, filed on Jul. 13, 2018, provisional application No. 62/662,222, filed on Apr. 25, 2018, provisional application No. 62/661,773, filed on Apr. 24, 2018.

(51) Int. Cl.
*A61H 1/02* (2006.01)

(52) U.S. Cl.
CPC ..... *A61H 1/0274* (2013.01); *A61H 1/0218* (2013.01); *A61H 2201/1418* (2013.01); *A61H 2201/1638* (2013.01); *A61H 2201/1664* (2013.01); *A61H 2201/1671* (2013.01); *A61H 2201/5071* (2013.01); *A61H 2205/06* (2013.01)

(58) Field of Classification Search
CPC .. A61H 1/0274; A61H 1/0218; A61H 1/0285; A61H 1/0237; A61H 7/007; A61H 2007/009; A61H 2201/1635; A61H 2201/1638; A61H 2201/164; A61H 2201/1642; A61F 5/04
See application file for complete search history.

(56) References Cited

U.S. PATENT DOCUMENTS

| | | | | |
|---|---|---|---|---|
| 5,279,545 | A | 1/1994 | Reese, Sr. | |
| 5,702,355 | A * | 12/1997 | Repice | A61F 5/0118 602/5 |
| 6,064,912 | A * | 5/2000 | Kenney | A61F 5/0118 602/5 |
| 2003/0199796 | A1* | 10/2003 | Yamazaki | A61H 7/007 601/134 |
| 2008/0139986 | A1* | 6/2008 | De Muinck | A61H 1/0274 602/40 |
| 2012/0253244 | A1* | 10/2012 | Femano | A61H 7/004 602/5 |
| 2022/0104991 | A1 | 4/2022 | Maier | |

* cited by examiner

*Primary Examiner* — Margaret M Luarca
*Assistant Examiner* — Cana A Gallegos
(74) *Attorney, Agent, or Firm* — Knobbe Martens Olson & Bear, LLP

(57) ABSTRACT

Devices and methods for treating carpal tunnel syndrome or DeQuervain's syndrome. The device may include a resting portion for receiving a user's forearm, first and second contact portions configured to contact the user's forearm, and a stretching mechanism configured to apply opposing forces to the first contact portion and the second contact portion to stretch the user's underlying tissue. The first contact portion may be configured to apply a compressive force to the user's forearm at a first location. The second contact portion may be configured to apply a compressive force to the user's forearm at a second location different than the first location.

23 Claims, 25 Drawing Sheets

MEDICAL DEVICE FOR TREATING CARPAL TUNNEL AND DE QUERVAIN'S SYNDROMES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

This application claims the benefit of U.S. Provisional Application No. 62/661,773, filed Apr. 24, 2018, U.S. Provisional Application No. 62/662,222, filed Apr. 25, 2018, and U.S. Provisional Application No. 62/697,765, filed Jul. 13, 2018, each of which is hereby incorporated by reference in its entirety.

BACKGROUND

Field

This application relates devices and methods for treating carpal tunnel and DeQuervain's syndromes.

Description of the Related Art

Many people suffer from carpal tunnel or DeQuervain's syndromes, which causes pain and loss of function in their hands. Surgical procedures for treating carpal tunnel and DeQuervain's syndromes are expensive, invasive, and, as per all surgeries, risk serious complications. Non-surgical treatments for carpal tunnel or DeQuervain's syndromes usually involve splinting a patient's wrist with a cock-up splint that keeps the patient's wrist in neutral or slight extension. Splints do not work well because they do not directly address the myofascial restrictions present on the back of patient wrists. Non-surgical treatments also take a long time and are not always effective. The lack of effectiveness of non-surgical treatment (and possibly the perceived need to see no other option but for election of surgery) stems from a lack of understanding about the etiology of carpal tunnel and DeQuervain's syndromes, and so do not effectively address the underlying pathology.

SUMMARY

There is a need for a medical device for treating carpal tunnel and DeQuervain's syndromes by releasing the myofascial restrictions that are the etiological causation for the underlying pathology. Manual release of myofascial restrictions is not always precise, strains the therapist's own hands, and may not produce the required amount of force needed to release said restrictions. The medical devices described herein release the myofascial restrictions by pushing into and spreading the tissues on a posterior side of a person's wrist and forearm, whereby resulting in the release of myofascial restrictions, reducing symptoms of carpal tunnel syndrome. Likewise, the medical device also releases myofascial restrictions along the anatomical distributions of the muscles abductor policis longus and extensor policis brevis to relieve symptoms of DeQuervain's syndrome. These devices remove the human element typically associated with myofascial release.

The medical devices described herein are capable of treating carpal tunnel syndrome or DeQuervain's syndrome. The medical devices generally include a resting portion for receiving a user's forearm, one or more contact portions configured to contact the user's forearm, one or more compressive force mechanisms configured to apply a compressive force to the user's forearm in a posterior-anterior direction, and/or a stretching mechanism configured to stretch the user's underlying tissue. For example, the medical devices may include one or more compressive force mechanisms configured to apply a compressive force to the user's forearm at a first contact portion and at a second contact portion. The stretching mechanism may be configured to apply opposing forces to the first contact portion and the second contact portion to stretch the user's underlying tissue in a direction other than the posterior-anterior direction. Additionally or alternatively to the compressive force mechanisms, the stretching mechanism may be configured to apply a compressive force to the user's forearm.

The stretching mechanism may include any suitable structure configured to stretch the user's underlying tissue. For example, the stretching mechanism may include a compression spring, a mechanical linkage, a torsion spring, a double ended screw, and/or a scissor mechanism.

The medical device may include one or more actuators configured to adjust the compressive forces being applied to the user's forearm and the opposing forces being applied to the first and second contact portions. For example, a single actuator may adjust both the compressive forces being applied to the user's forearm and the opposing forces being applied to the first and second contact portions. As another example, separate actuators may adjust the compressive forces being applied to the user's forearm and the opposing forces being applied to the first and second contact portions. A single actuator or separate actuators may adjust the compressive forces being applied at each of the contact portions.

The medical device may include a locking mechanism configured to lock a position of the first and second contact portions relative to the resting portion and/or a release mechanism configured to release the position of the first and second contact portions relative to the resting portion.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No individual aspects of this disclosure are essential or indispensable.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure.

DETAILED DESCRIPTION

The present application relates to medical devices for treating carpal tunnel and DeQuervain's syndromes. The devices described herein are adapted to receive and support a user's forearm and release myofascial restrictions by selectively pushing into and spreading the relevant wrist and forearm tissue with adjustable vertical (generally anterior-posterior direction) and non-vertical forces. The forearm can include any portion of the user's forearm from the elbow to the fingertips. These devices can be used under the supervision of a physical therapist, an occupational therapist, or a doctor or in the patient's home.

FIGS. 1 to 5 illustrate a medical device 100 for treating carpal tunnel and DeQuervain's syndromes, which may include any feature of the other embodiments described herein. The medical device 100 includes a resting portion 30 for receiving a user's forearm, one or more contact portions 60*a*, 60*b* for contacting the user's forearm opposite the resting portion 30, one or more compressive force mechanisms 40 configured to apply a compressive force to the user's forearm in a posterior-anterior direction, and/or a stretching mechanism 50 configured to stretch the user's underlying tissue.

Figure 1:
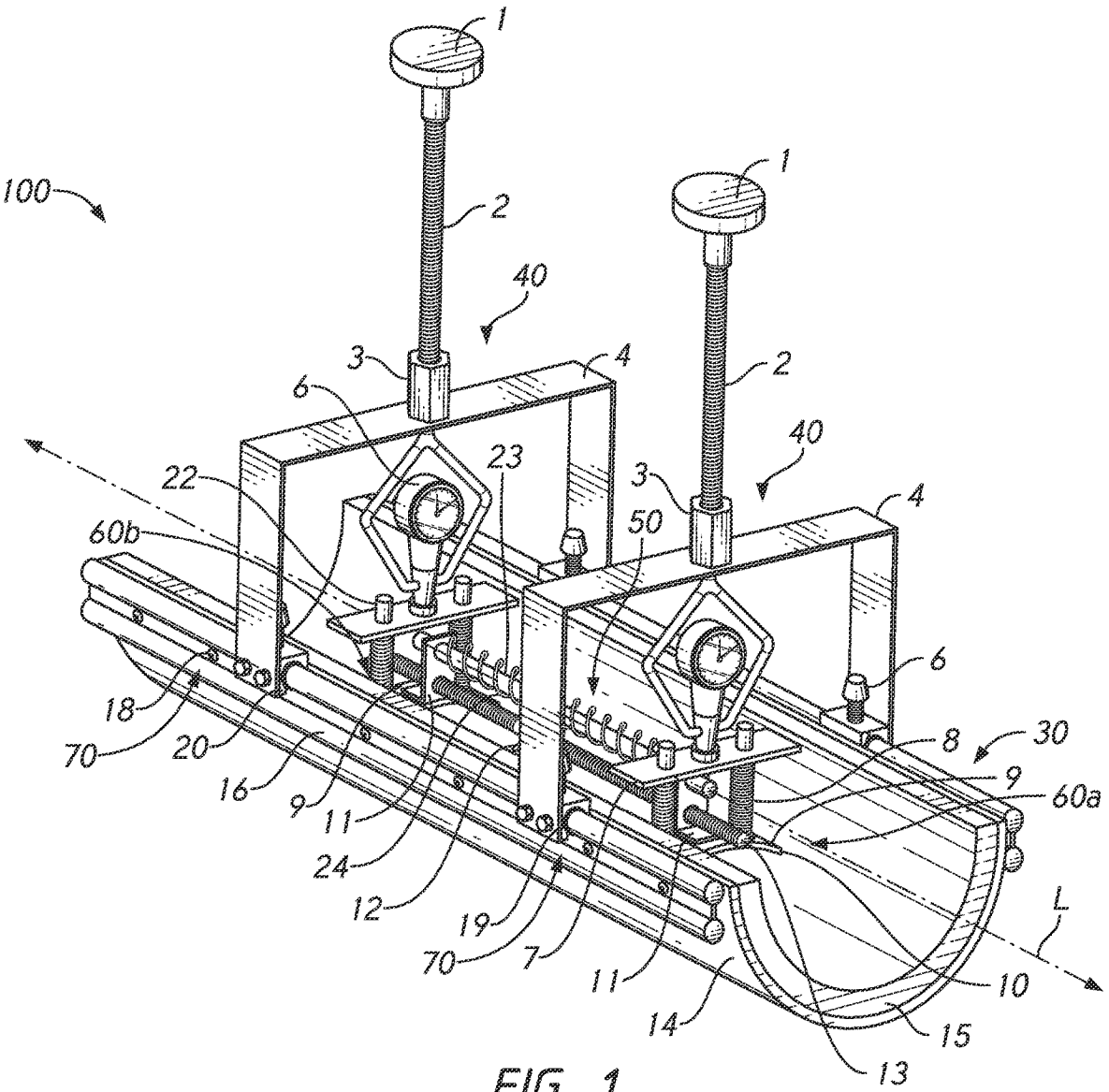
FIG. 1 is a perspective view of an embodiment of a medical device.

As shown in FIG. 1, the resting portion 30 may include a device frame 14 at the base of the medical device 100 and/or a forearm pad 15 lining the device frame 14. The resting portion 30 may define an arcuate shape dimensions and adapted to support the forearm of the user. The arcuate resting portion 30 may hold the patient's forearm in slight flexion and present the target tissues on the posterior side of the wrist in a better position to be stretched. However, the resting portion 30 may take on any configuration suitable for the patient to rest their forearm during treatment. For example, the resting portion 30 may provide a planar surface for the user to rest their forearm.

The medical device 100 may also include one or more contact portions 60*a*, 60*b* for contacting the user's forearm, for example the posterior side of the user's forearm. As shown in FIG. 1, the medical device may include two contact portions 60*a*, 60*b* adapted to transfer the vertical and non-vertical forces to the underlying tissue. The one or more contact portions may include a first contact portion 60*a* to contact the user's forearm at a first location and a second contact portion 60*b* to contact the user's forearm at a second location, different from the first location. The two contact portions 60*a*, 60*b* may be adjusted relative to each other such that the contact portions 60*a*, 60*b* can be properly positioned. For example, a first contact portion 60*a* may be positioned over the user's radius and/or ulna bones and a second contact portion 60*b* may be positioned over the user's carpal and/or metacarpal bones. Each contact portion 60*a*, 60*b* may include a contact plate 9 and/or a skin contact pad 10 adapted for patient comfort when engaging the skin contact plate 9.

Figure 2:
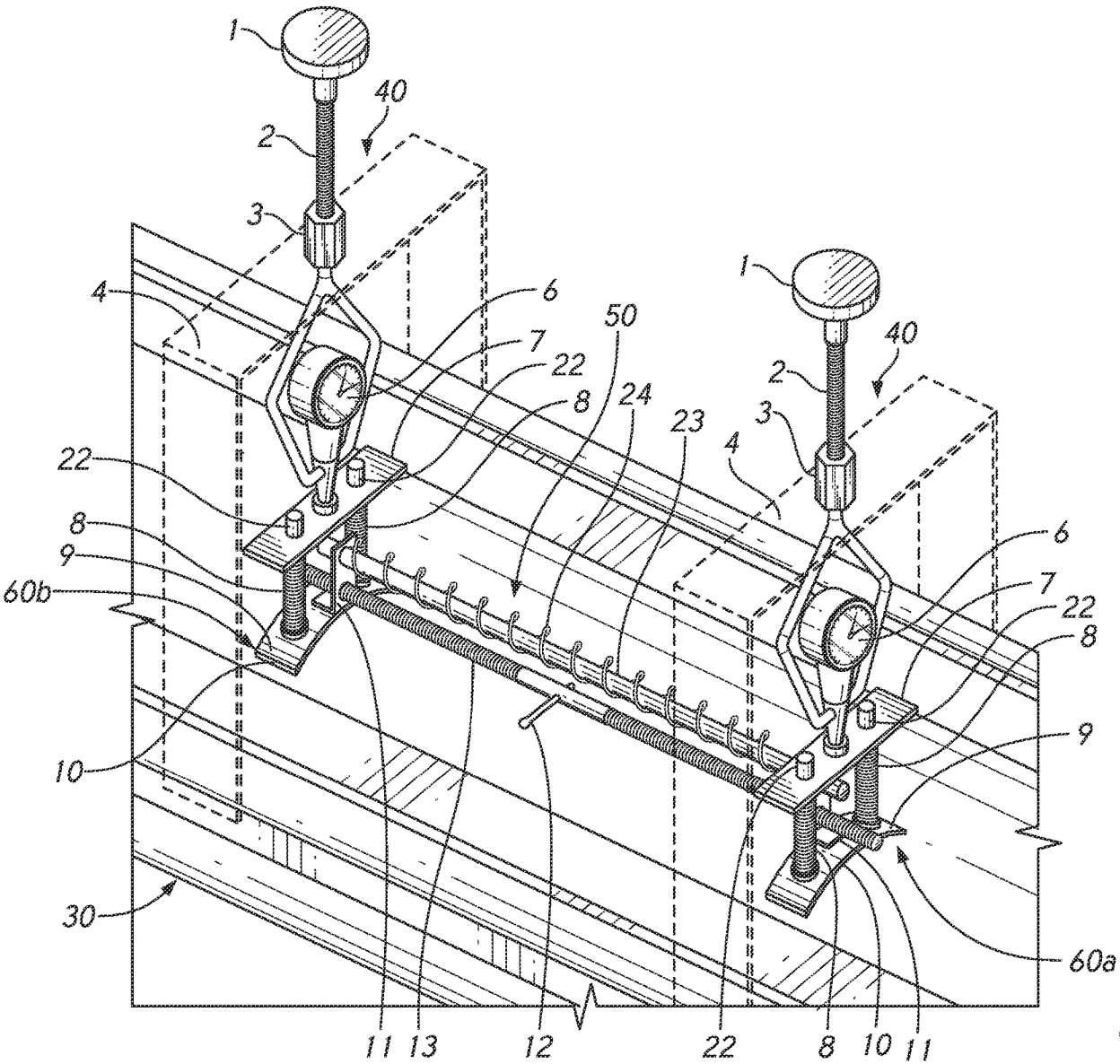
FIG. 2 is a partial view of the medical device shown in FIG. 1.

The medical device 100 may include one or more compressive force mechanisms 40 for applying a compressive force to the user's forearm at the one or more contact portions 60*a*, 60*b* in a generally anterior-posterior direction. As shown in FIG. 2, the medical device 100 includes a compressive force mechanism 40 for each contact portion 60*a*, 60*b*. Each compressive force mechanism 40 may include an actuator 1 adapted to move the contact portions 60*a*, 60*b* between a disengaged condition and an engaged condition with the user's forearm. In the disengaged condition, a user may insert their forearm into the resting portion 30. The compressive force mechanism 40 may include one or more elastic members 8 capable of storing mechanical energy, for example a compression spring. The compressive force mechanism 40 may also include one or more features between the actuator 1 and the one or more elastic members 8 such that the actuator 1 indirectly interfaces with the one or more elastic members 8. The amount of force being applied may vary depending on the patient, for example depending on the amount of adipose tissue present.

As shown in FIG. 2, the actuator 1 may be a knob that drives a threaded rod 2, received by a rod receptor 3, to transfer the compressive force. The compressive force may be transferred to a gauge 6, such as an algometer or a load cell, to provide an objective measure of pressure. The gauge 6 may transfer the compressive force to a base plate 7. The base plate 7 may transfer the compressive force to one or more elastic members 8 extending between the base plate 7 and the contact plate 9. In the figures, the one or more elastic members 8 are illustrated as compression springs. One or more guide rods 22 may extend between the base plate 7 and the skin contact plates 9. The one or more rods 22 act as a guide for a respective elastic member 8. Although FIG. 2 illustrates a particular compressive force mechanism 40, any one of the features described above could be rearranged, removed, or substituted. For example, the compressive force mechanism 40 may not include a gauge 6. Instead, the therapist may rely on the patient's opinion about the pressure.

Figure 3:
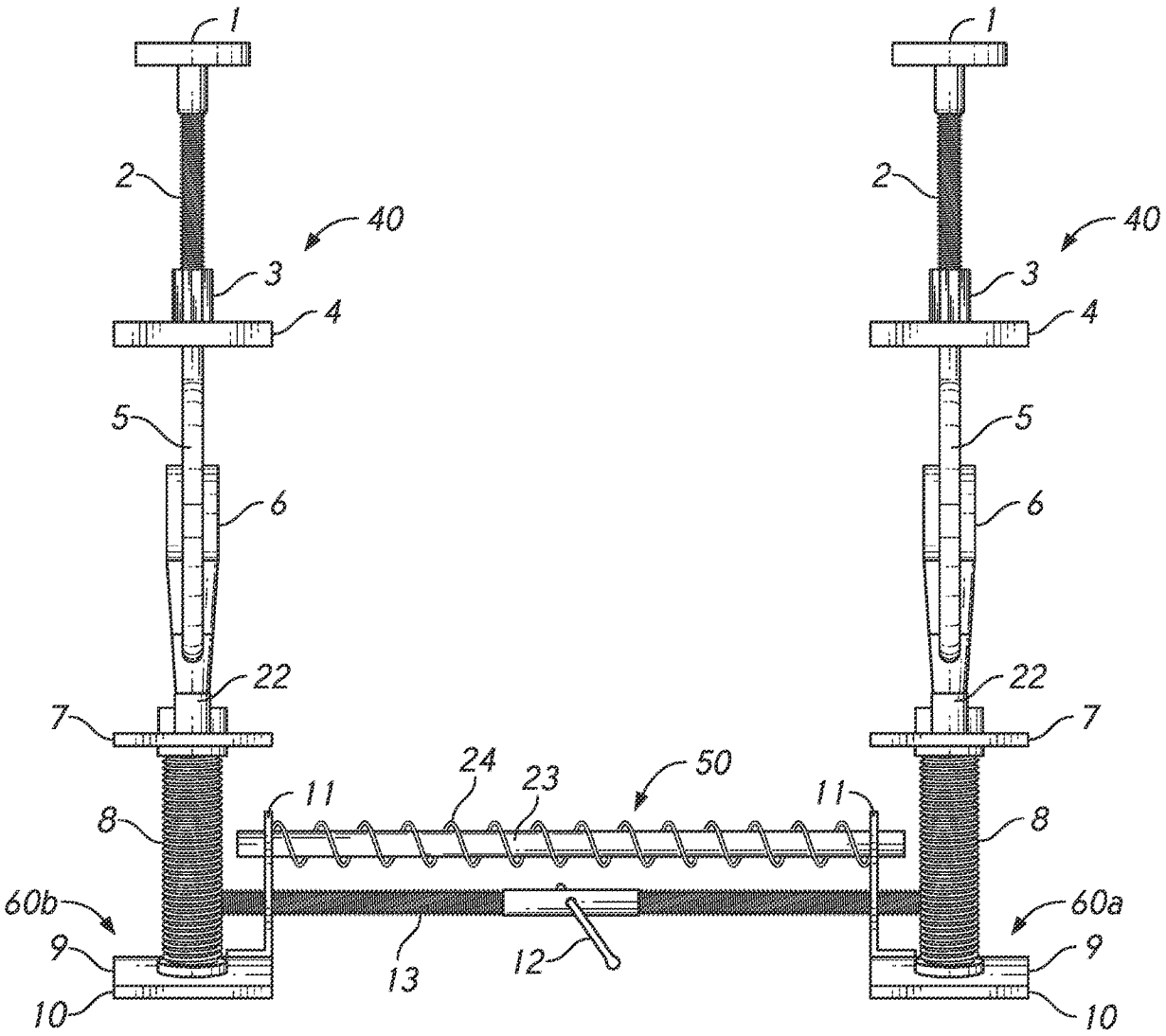
FIG. 3 illustrates the compressive force mechanisms and the stretching mechanism of the medical device shown in FIG. 1.

The medical device 100 can also include a stretching mechanism 50 configured to apply opposing forces to the first and second contact portions 60*a*, 60*b* to stretch the user's tissue. The stretching mechanism may include an actuator 12 adapted to apply the opposing forces to the first and second contact portions 60*a*, 60*b*. For example, as shown in FIG. 3, the actuator 12 may be an adjustable pin adapted to transfer non-vertical forces, for example in the proximal-distal direction, to the contact portions 60*a*, 60*b*. The adjustable pin 12 is adapted so that that, when twisted, a force is urged against the contact portions 60*a*, 60*b* along the longitudinal axis L of the resting portion 30.

The actuator 12 may be used to translate the contact portions 60*a*, 60*b* relative to each other along a longitudinal axis of the resting portion 30. For example, as shown in FIG. 3, the stretching mechanism 50 may include a double ended screw 13 extending between the contact portions 60*a*, 60*b*. The double ended screw 13 may include a first end adapted to transfer force to the first contact portion 60*a* via an adaptor 11 and a second end adapted to transfer force to the second contact portion 60*b* via an adaptor 11. One end of the double ended screw 13 may have right handed threads while the other end of the screw 13 may have left handed threads. As the actuator 12 is activated, the adaptors 11 are driven along the double ended screw 13.

The stretching mechanism 50 may also include a horizontal spring 24 extending between the first contact portion 60*a* and the second contact portion 60*b*. The horizontal spring 24 may encircle a guide rod 23. A first end of the guide rod 23 may be attached to the adaptor 11 and a second end of the guide rod 23 may be attached to the other adaptor 11. As the contact portions 60*a*, 60*b* move toward each other along the guide rod 23, the horizontal spring 24 is further compressed.

Figure 4:
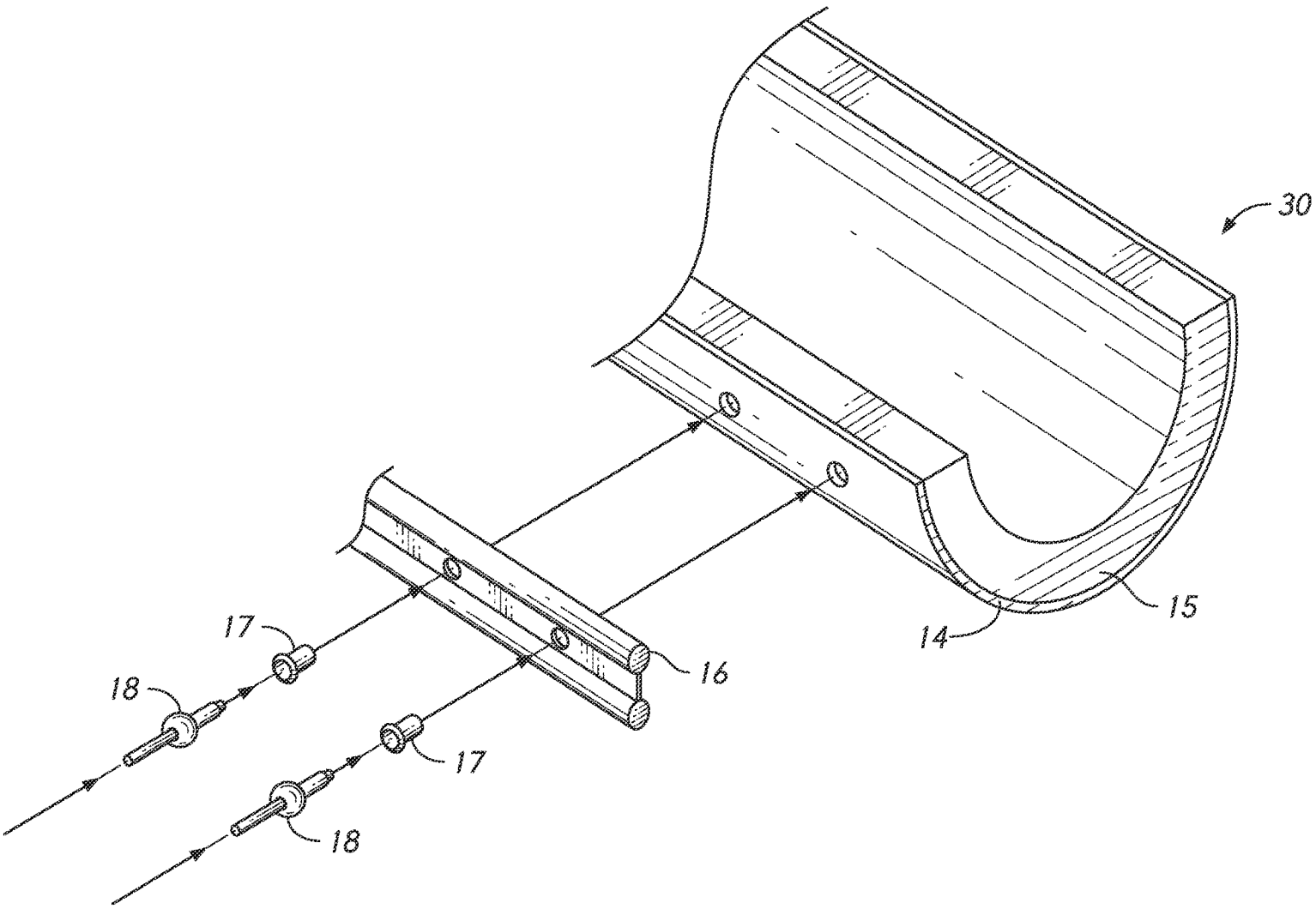
FIG. 4 is a partial exploded view of the resting portion of the medical device shown in FIG. 1.
Figure 5:
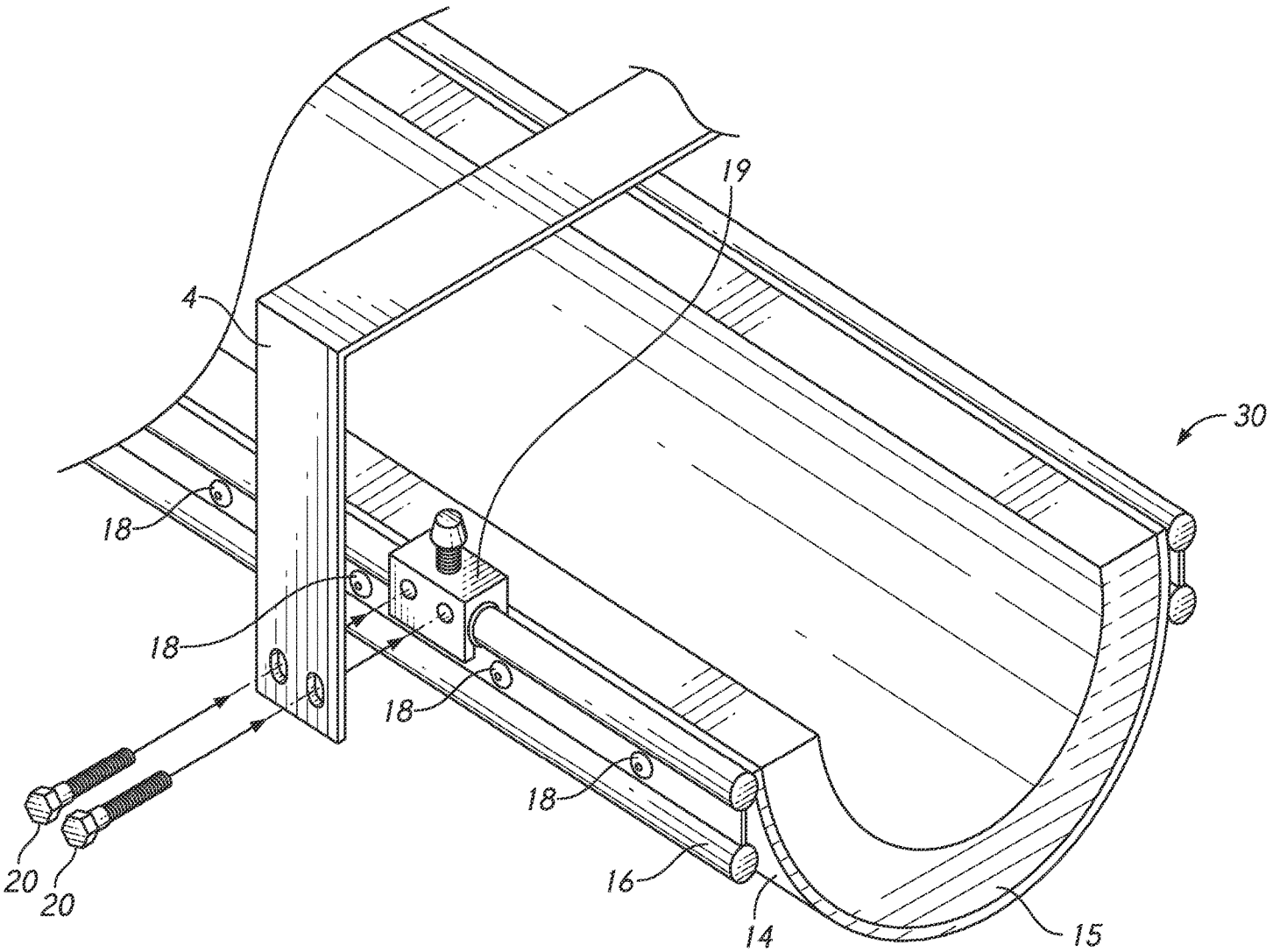
FIG. 5 is another partial exploded view of the resting portion of the medical device shown in FIG. 1.

The medical device 10 may also include an adjustment mechanism 70 configured to adjust the relative position of the contact portions 60*a*, 60*b* to accommodate different patients. For example, each contact portion 60*a*, 60*b* may be slidable along a longitudinal axis L of the resting portion 30. As shown in FIG. 1, each contact portion 60*a*, 60*b* may be directly or indirectly attached to a frame 4. The frames 4 may slide along rails 16 positioned on the device frame 14 to position the contact portions 60*a*, 60*b* along the user's forearm. A rail connector 19 may interconnect each of two opposing anterior ends of each frame 4 to the opposing rails 16, respectively, so that each frame 4 may selectively slide along the rails 16. The rail connector 19 may utilize fastener elements 17, 18, 20 to facilitate this functionality. As shown in FIG. 4, shelf pin sleeves 17 are adapted to support the rail connections to the device frame 14, and blind rivets 18 attach the rails 16 to the device frame 14. As shown in FIG. 5, rail connectors 19 position the compressive force mechanisms 40 along the rails 16, and partially threaded bolts 20 are adapted to attach each frame 4 to the rail connectors 19.

In use, a user may have a patient place their forearm on the forearm pad 15. The user may selectively slide the frames 4 along the rails 16 so that the respective contact portions 60*a*, 60*b* are within 0 to 30 centimeters from each other on the patient's skin. For example, the first contact portion 60*a* may be positioned over the user's radius and/or ulna bones and the second contact portion 60*b* may be positioned over the user's carpal and/or metacarpal bones. The contact portions 60*a*, 60*b* are moved to an engaged condition, for example using the one or more actuators 1, until a comfortable pressure is felt by the patient, which is typically between 0 lbf to 200 lbf on the gauge 6. The user may manipulate the stretching mechanism 50 so as to transfer non-vertical force to the engaged contact portions 60*a*, 60*b*, providing a comfortable stretch of the tissue along the patient's forearm. With these settings, the contact portions 60*a*, 60*b* are adapted to transfer compressive and stretching forces to said tissue. The one or more elastic members 8 keep generally constant compressive force on the tissue while the stretching mechanism 50 is engaged. The opposing forces are sufficient to stretch the underlying tissue, but at most, nominally move the contact portions 60*a*, 60*b*. For example, when compressive forces of up to 200 lbf are applied to the contact portions 60*a*, 60*b*, the contact portions 60*a*, 60*b* are configured to move no more than 3 inches, no more than 2 inches, no more than 1 inch, no more than 0.5 inch, or not at all, when the stretching mechanism 50 is engaged. The tissue is stretched for 0 to 30 minutes and then the device 100 is disengaged from the patient.

If treating carpal tunnel syndrome, the contact portions 60*a*, 60*b* are positioned so that the first contact portion 60*a* is on the extensor retinaculum of the wrist and the second contact portion 60*b* is greater than 0 and/or less than 30 cm away on the tissue adjacent to the first contact portion 60*a*, for example less than 20 cm away, less than 10 cm away, less than 5 cm away, or less than 1 cm away. The compressive force mechanisms 40 are then moved to the engaged condition so that the patient feels a comfortable, relatively equal pressure from both contact portions 60*a*, 60*b*. The stretching mechanism 50 is then engaged so that a comfortable stretch is felt in the patient's tissue. The stretch is held for 0 to 30 minutes and then released. To treat DeQuervain's syndrome, the same procedure described above is used except the contact portions 60*a*, 60*b* are positioned anywhere along the muscle bellies or tendons of abductor policis longus and extensor policis brevis in the forearm.

With reference to FIGS. 6 to 11, another illustrative embodiment of a medical device is shown. The medical device 200 resembles or is identical to the medical device 100 discussed above in many respects. Accordingly, numerals used to identify features of the medical device 100 are incremented by a factor of one hundred (100) to identify like features of the medical device 200. This numbering convention generally applies to the remainder of the figures. Any component or step disclosed in any embodiment in this specification can be used in any other embodiment.

FIGS. 6 to 11 illustrate a medical device 200 for treating carpal tunnel and DeQuervain's syndromes. The medical device 100 includes a resting portion 130 for receiving a user's forearm, one or more contact portions 160*a*, 160*b* for contacting the user's forearm opposite the resting portion 130, one or more compressive force mechanisms 140 configured to apply a compressive force to the user's forearm in a posterior-anterior direction, and/or a stretching mechanism 150 configured to stretch the user's underlying tissue.

Figure 6:
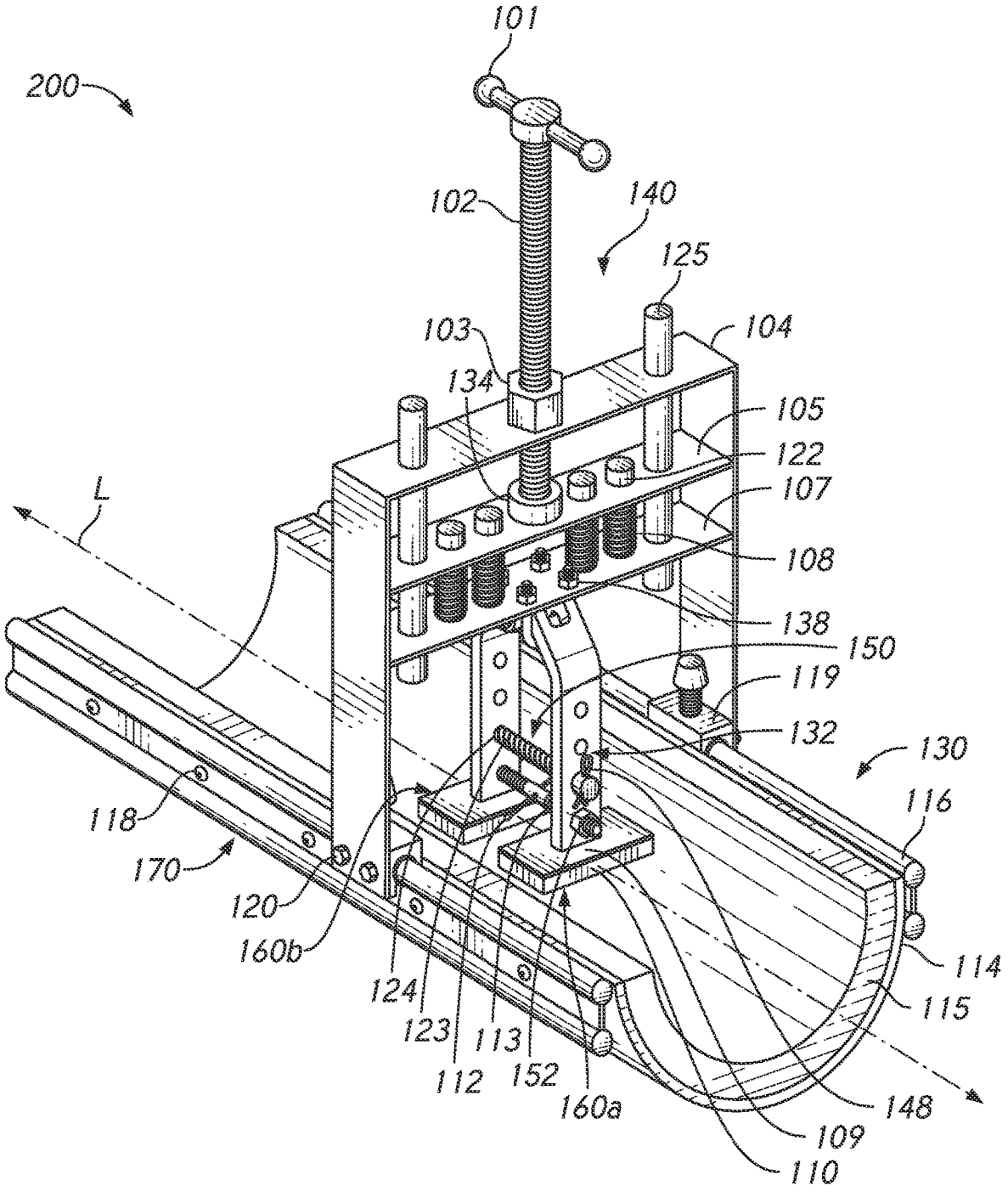
FIG. 6 is a perspective view of another embodiment of the medical device.

As shown in FIG. 6, the resting portion 130 may include a device frame 114 at the base of the medical device 200 and/or a forearm pad 115 lining the device frame 114. The resting portion 130 may define an arcuate shape adapted to support the forearm of the user. The arcuate resting portion 130 may hold the patient's forearm in slight flexion and present the target tissues on the back of the wrist. However, the resting portion 130 may take on any configuration suitable for the patient to rest their forearm during treatment. For example, the resting portion 130 may provide a planar surface for the user to rest their forearm.

The medical device 200 may also include one or more contact portions 160*a*, 160*b* for contacting the user's forearm, for example the posterior side of the user's forearm. As shown in FIG. 6, the medical device 200 may include two contact portions 160*a*, 160*b* adapted to transfer the vertical and non-vertical forces to the underlying tissue. The one or more contact portions may include a first contact portion 160*a* to contact the user's forearm at a first location and a second contact portion 160*b* to contact the user's forearm at a second location, different from the first location. The two contact portions 160*a*, 160*b* may be adjusted relative to each other such that the contact portions 160*a*, 160*b* can be properly positioned. For example, a first contact portion 160*a* may be positioned over the user's radius and/or ulna bones and a second contact portion 160*b* may be positioned over the user's carpal and/or metacarpal bones. Each contact portion 160*a*, 160*b* may include a contact plate 109 and/or a skin contact pad 110 adapted for patient comfort when engaging the skin contact plate 109.

Figure 7:
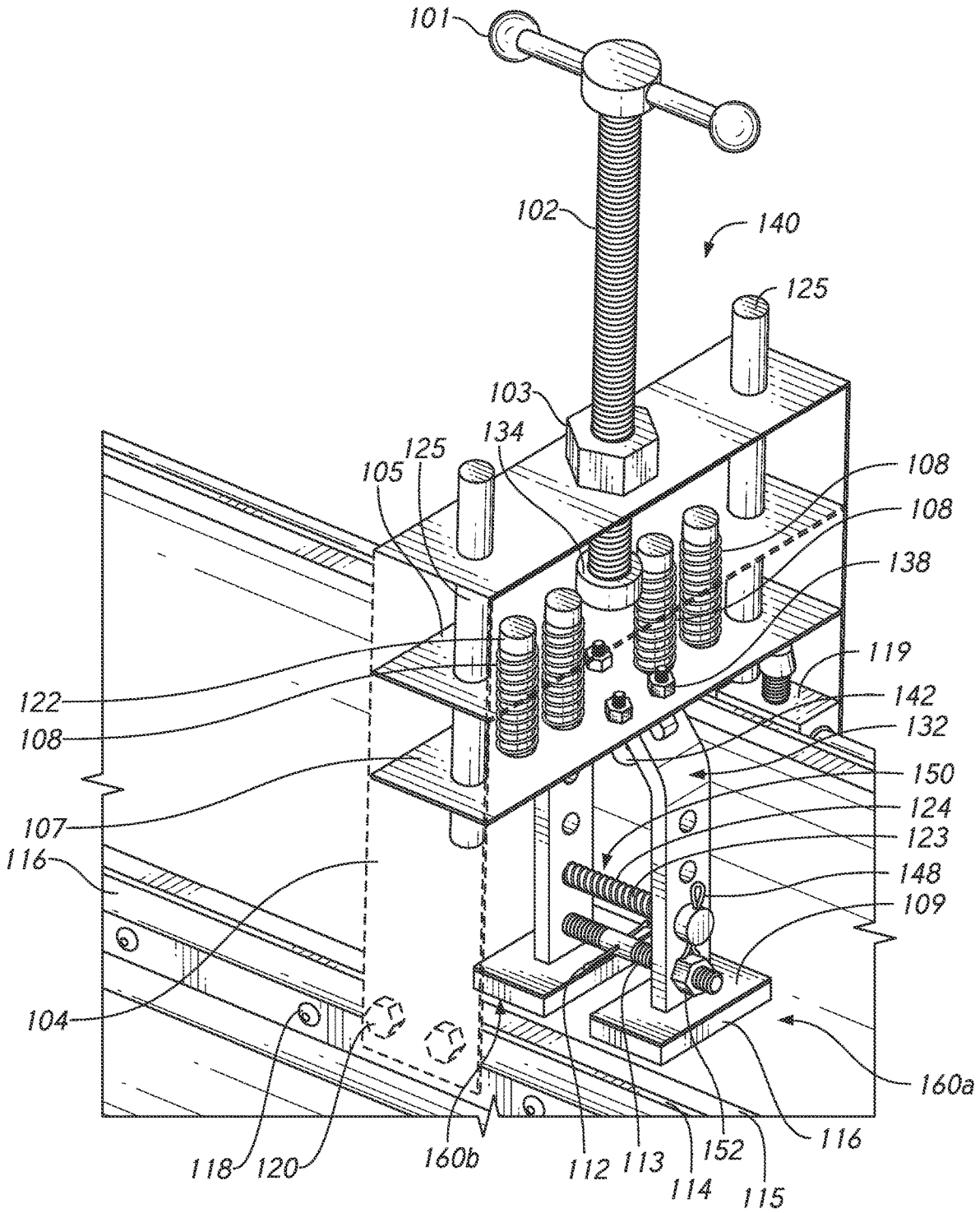
FIG. 7 is a partial view of the medical device shown in FIG. 6.

The medical device 100 may include one or more compressive force mechanisms 140 for applying a compressive force to the user's forearm at the one or more contact portions 160*a*, 160*b* in a generally anterior-posterior direction. As shown in FIG. 7, the medical device 200 includes a single compressive force mechanism 140 for both contact portions 160*a*, 160*b*. The compressive force mechanism 140 may include an actuator 101 adapted to move the contact portions 160*a*, 160*b* between a disengaged condition and an engaged condition with the user's forearm. In the disengaged condition, a user may insert their forearm into the resting portion 130. The compressive force mechanism 140 may include one or more elastic members 108 capable of storing mechanical energy, for example a compression spring. The compressive force mechanism 140 may also include one or more features between the actuator 101 and the one or more elastic members 108 such that the actuator 101 indirectly interfaces with the one or more elastic members 108. The amount of force being applied may vary depending on the patient, for example depending on the amount of adipose tissue present.

As shown in FIG. 7, the actuator 101 may be a knob that drives a threaded rod 102, received by a rod receptor 103, to transfer the compressive force to one or more elastic members 108 extending between an upper plate 105 and the base plate 107. The upper plate 105 includes an adapter 134 to receive the threaded rod 102. In the figures, the one or more elastic members 108 are illustrated as compression springs. The one or more elastic members 108 may transfer the compressive force to a base plate 107. One or more guide rods 122 may extend between the upper plate 105 and the base plate 107. The one or more guide rods 122 may act as a guide for a respective elastic member 108. The base plate 107 may transfer the compressive force to the contact plates 109 through a frame member 132. Additional rods 125 may provide support and guide the compressive force mechanism 140. At least the base plate 107 may be slidable along the rods 125 so the user may input or remove their forearm from the resting portion 130. Although FIG. 7 illustrates a particular compressive force mechanism 140, any one of the features described above could be rearranged, removed, or substituted or additional features could be added. For example, the compressive force mechanism 140 could include a gauge as described above in connection with the medical device 100.

Figure 8:
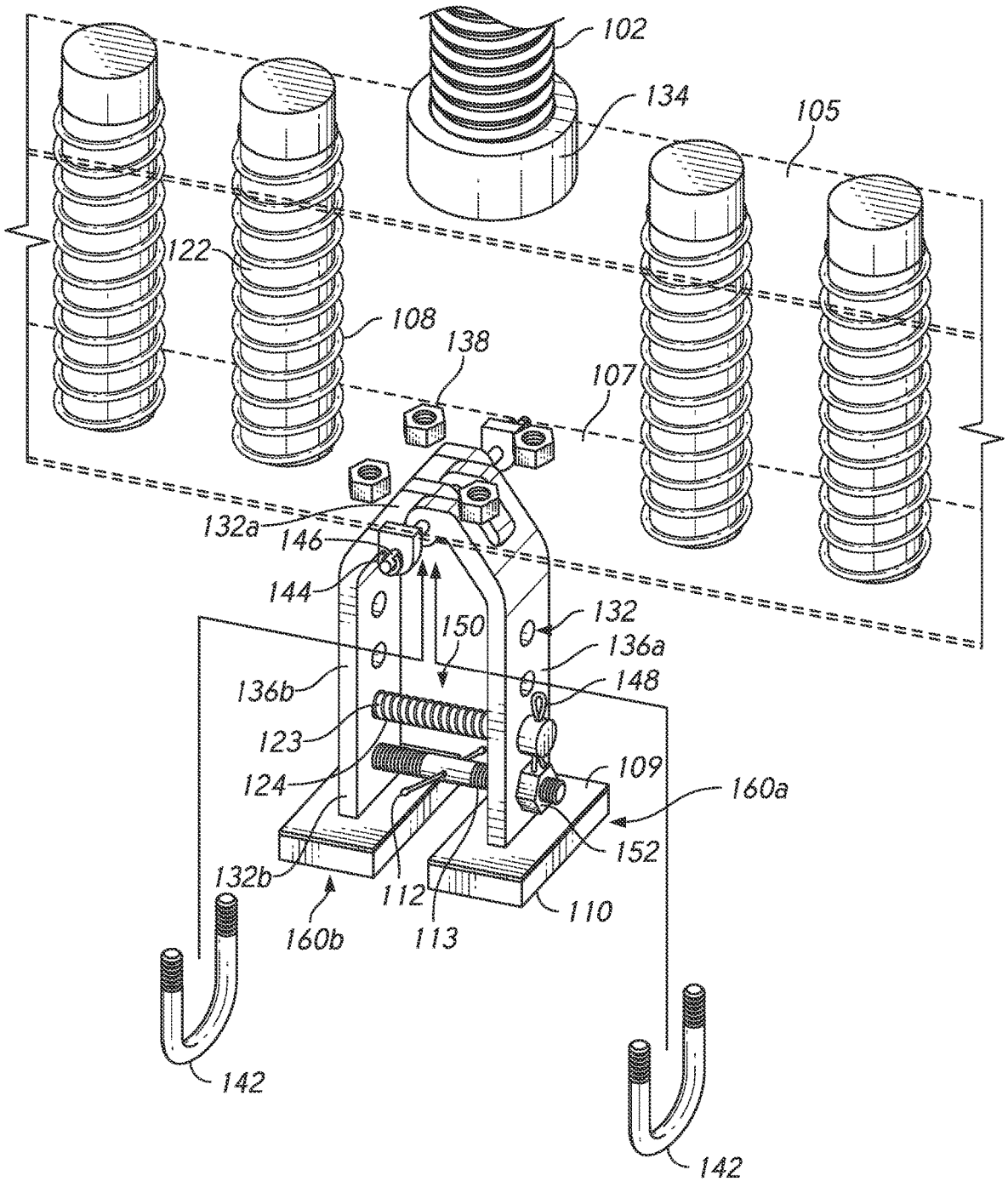
FIG. 8 is a partial exploded view of the stretching mechanism of the medical device shown in FIG. 6.

As illustrated in FIG. 8, the frame member 132 has a general upside down U-shape such that a single compressive force mechanism 140 can apply compressive forces to two contact portions 160*a*, 160*b*. The posterior end 132*a* of the frame member 132 may be attached to the base plate 107, while the anterior ends 132*b* of the frame member 132 may be attached to respective contact portions 160*a*, 160*b*. For example, the frame member 132 may have a first leg 136*a* attached to the first contact portion 160*a* and a second leg 136*b* attached to the second contact portion 160*b*. The posterior end 132*a* of the frame member 132 may be attached to the base plate 107 by one or more fasteners, such as one or more u-bolt adapters 138, u-bolts 142, retaining discs 144, and/or securing rods 146.

The medical device 200 can also include a stretching mechanism 150 configured to apply opposing forces to the first and second contact portions 160*a*, 160*b* to stretch the user's underlying tissue. The stretching mechanism 150 may include an actuator 112 adapted to apply the opposing forces to the first and second contact portions 160*a*, 160*b*. For example, as shown in FIG. 8, the actuator 112 may be an adjustable pin adapted to transfer non-vertical forces, for example in the proximal-distal direction, to the contact portions 160*a*, 160*b*. The adjustable pin 112 is adapted so that that, when twisted, a force is urged against the contact portions 160*a*, 160*b* along the longitudinal axis L of the resting portion 130.

Figure 9:
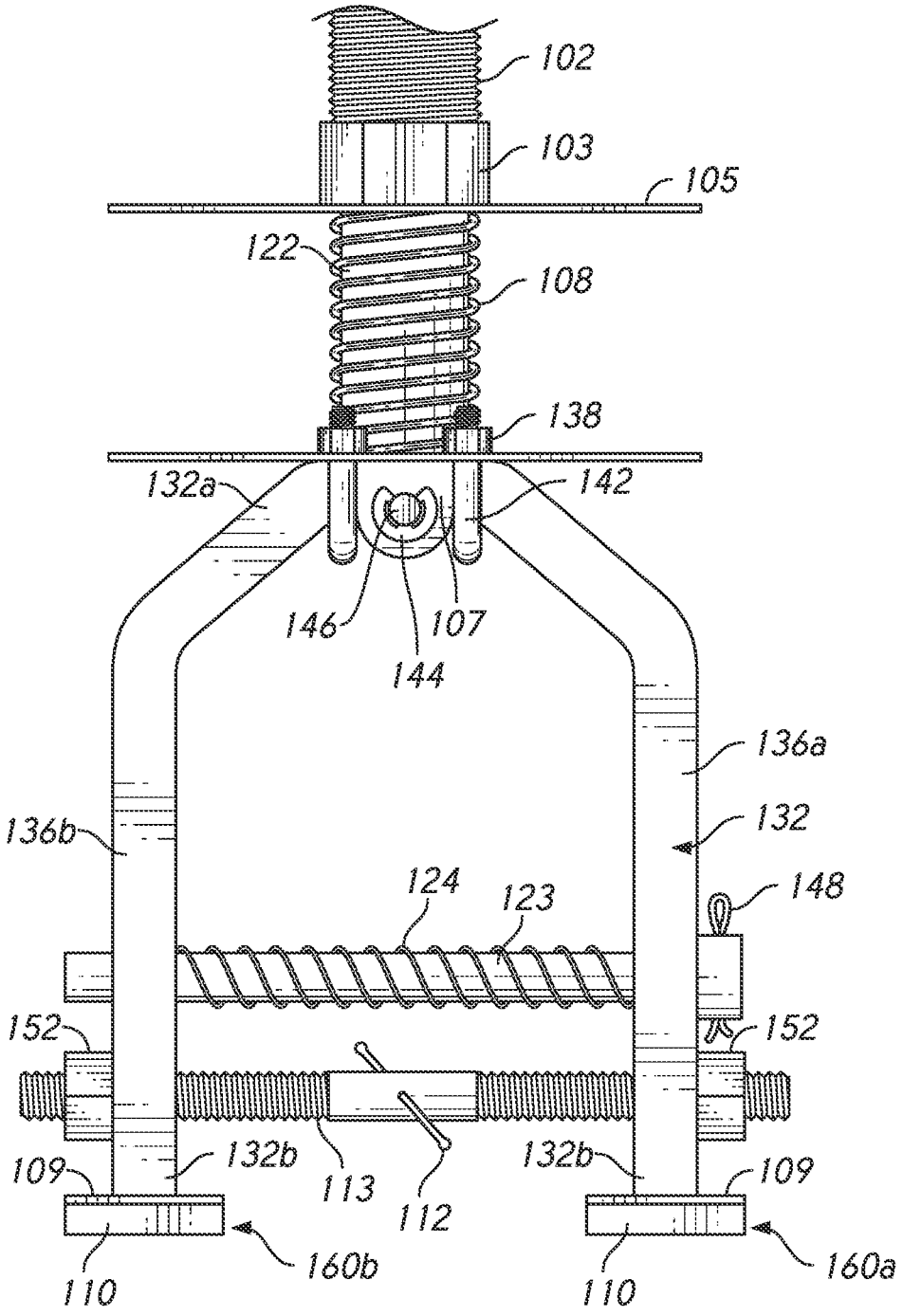
FIG. 9 is partial, elevation view of the stretching mechanism of the medical device shown in FIG. 6.

The actuator 112 may be used to translate the contact portions 160*a*, 160*b* relative to each other along a longitudinal axis of the resting portion 130. For example, as shown in FIG. 9, the stretching mechanism 150 may include a double ended screw 113 extending between the contact portions 160*a*, 160*b*. The double ended screw 113 may include a first end adapted to transfer force to the first contact portion 160*a* via the first leg 136*a* of the frame 132 and a second end adapted to transfer force to the second contact portion 160*b* via the second leg 136*b* of the frame 132. One end of the double ended screw 113 may have right handed threads while the other end of the screw 113 may have left handed threads. As the actuator 112 is activated, the contact portions 160*a*, 160*b* are driven along the double ended screw 113.

The stretching mechanism 150 may also include a horizontal spring 124 extending between the first contact portion 160*a* and the second contact portion 160*b*. The horizontal spring 124 may encircle a guide rod 123. A first end of the guide rod 123 may be attached to the first leg 136*a* of the frame 132 and a second end of the guide rod 123 may be attached to a second leg 136*b* of the frame 132. One or both ends of the guide rod 123 may be attached to the frame 132 using a fastener such as retaining pin 148. As the contact portions 160*a*, 160*b* move toward each other along the guide rod 123, the horizontal spring 124 is further compressed.

Figure 10:
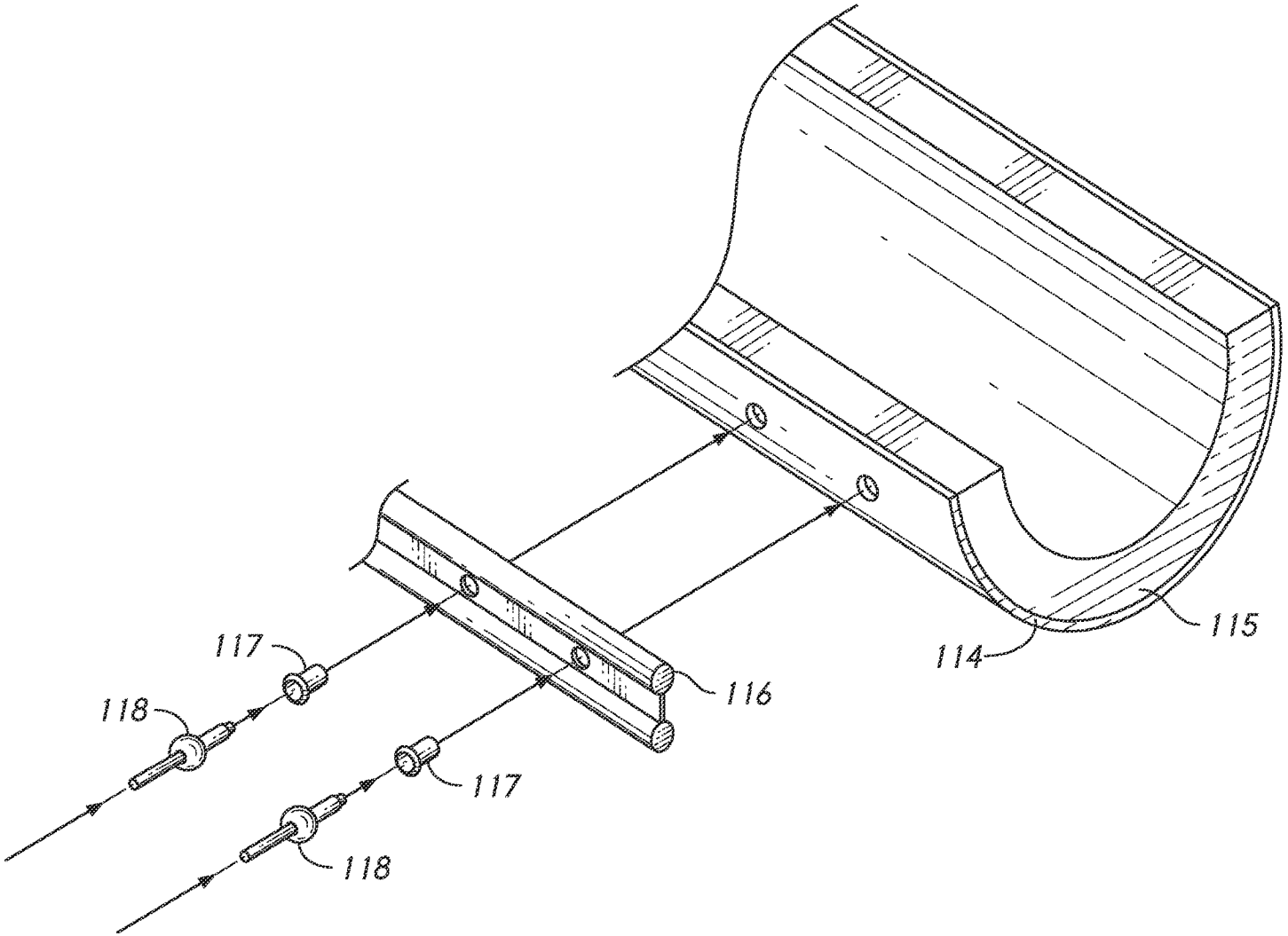
FIG. 10 is a partial exploded view of the resting portion of the medical device shown in FIG. 6.

The medical device 200 may also include an adjustment mechanism 170 configured to adjust the position of the contact portions 160*a*, 160*b*. For example, the contact portions 160*a*, 160*b* may be slidable along a longitudinal axis L of the resting portion 130. As shown in FIG. 6, each contact portion 160*a*, 160*b* may be directly or indirectly attached to a frame 104. The frames 104 may slide along rails 116 positioned on the device frame 114 to position the contact portions 160*a*, 160*b* along the user's forearm. A rail connector 119 may interconnect each of two opposing anterior ends of each frame 104 to the opposing rails 116, respectively, so that the frame 104 may selectively slide along the rails 16. The rail connector 119 may utilize fastener elements 117, 118, 120 to facilitate this functionality. As shown in FIG. 10, shelf pin sleeves 117 are adapted to support the rail connections to the device frame 114, and blind rivets 118 attach the rails 116 to the device frame 114.

Figure 11:
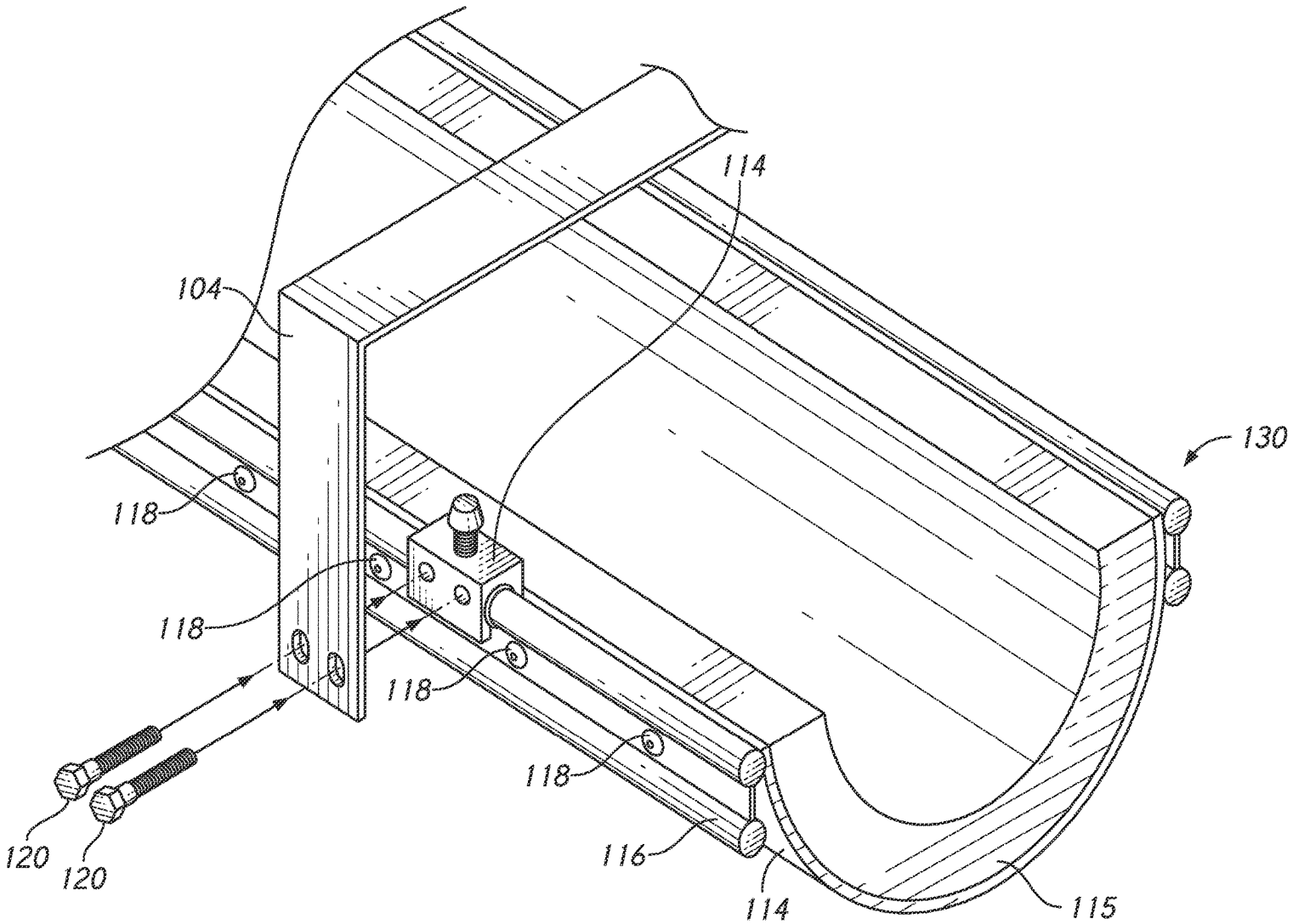
FIG. 11 is a partial exploded view of the resting portion of the medical device shown in FIG. 6.

As shown in FIG. 11, rail connector 119 position the compressive force mechanism 140 along the rails 116, and partially threaded bolts 120 are adapted to attach the frame 104 to the rail connector 119.

In use, a user may have a patient place their forearm on the forearm pad 115. The user may selectively slide the frame 104 along the rails 116 so that the respective contact portions 160*a*, 160*b* are positioned over the desired treatment area over the patient's skin. The contact portions 160*a*, 160*b* are moved to an engaged condition, for example using the one or more actuators 101, until a comfortable pressure is felt by the patient, which is typically between 0 lbf to 200 lbf. The user may manipulate the stretching mechanism 150 so as to transfer non-vertical force to the engaged contact portions 160*a*, 160*b*, providing a comfortable stretch of the tissue along the patient's forearm. With these settings, the contact portions 160*a*, 160*b* are adapted to transfer compressive and stretching forces to said tissue. The one or more elastic members 108 keep generally constant compressive force on the tissue while the stretching mechanism 150 is engaged. The opposing forces are sufficient to stretch the underlying tissue, but at most, nominally move the contact portions 160*a*, 160*b*. For example, when forces of up to 200 lbf are applied to the contact portions 160*a*, 160*b*, the contact portions 160*a*, 160*b* are configured to move no more than 3 inches, no more than 2 inches, no more than 1 inch, no more than 0.5 inch, or not at all, when the stretching mechanism 150 is engaged. The tissue is stretched for 0 to 30 minutes and then the device is disengaged from the patient.

If treating carpal tunnel syndrome, the contact portions 160*a*, 160*b* are positioned so that a first contact portion 160*a* is on the extensor retinaculum of the wrist and the second contact portion 160*b* closer to the patient's elbow and adjacent the first contact portion 160*a*. The compressive force mechanism 140 is then moved to the engaged condition so that the patient feels a comfortable, relatively equal pressure from both contact portions 160*a*, 160*b*. The stretching mechanism 150 is then engaged so that a comfortable stretch is felt in the patient's tissue. The stretch is held for 0 to 30 minutes and then released. To treat DeQuervain's syndrome, the same procedure described above is used except the contact portions 160*a*, 160*b* are positioned anywhere along the muscle bellies or tendons of abductor policis longus and extensor policis brevis in the forearm.

FIGS. 12 to 15 illustrate a medical device 300 for treating carpal tunnel and DeQuervain's syndromes, which may include any feature of the other embodiments described herein. The medical device 300 includes a resting portion 230 for receiving a user's forearm, one or more contact portions 260*a*, 260*b* for contacting the user's forearm opposite the resting portion 230, one or more compressive force mechanisms 240 configured to apply a compressive force to the user's forearm in a posterior-anterior direction, and/or a stretching mechanism 250 configured to stretch the user's underlying tissue. The medical device 300 also includes a device frame 290 for supporting the one or more compressive force mechanisms 240 and/or the stretching mechanism 250.

Figure 12:
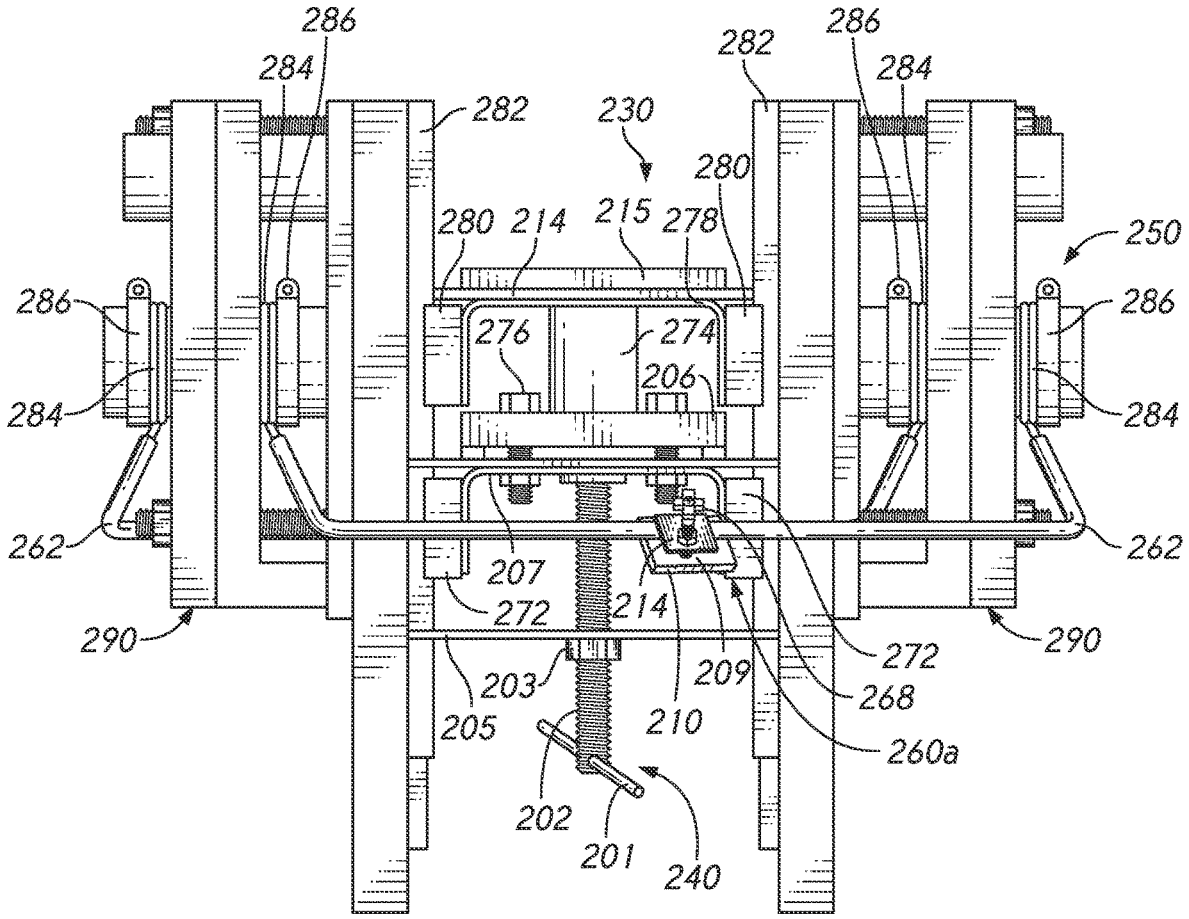
FIG. 12 is an elevation view of yet another embodiment of the medical device.
Figure 13:
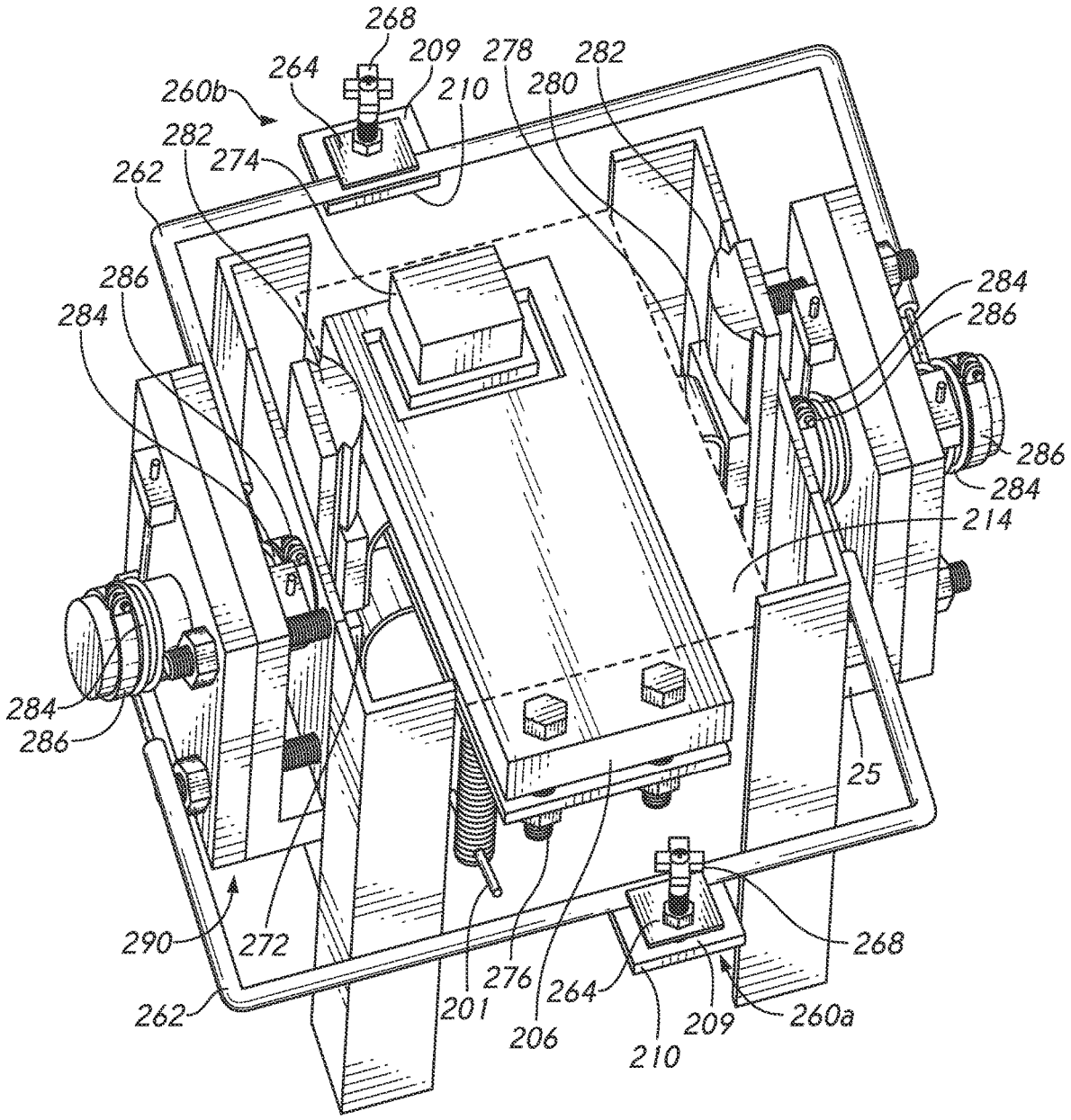
FIG. 13 is a perspective view of the medical device shown in FIG. 12.

As shown in FIG. 12, the resting portion 230 may include a frame 214 supporting a forearm pad 215. Unlike the above-described embodiments, the resting portion 230 is positioned closer to an upper end of the device 300 than a lower end of the device 300. The resting portion 230 may define a flat surface adapted to support the forearm of the user. However, the resting portion 230 may take on any configuration suitable for the patient to rest their forearm during treatment. For example, the resting portion 230 may provide an arcuate surface for the user to rest their forearm.

Figure 14:
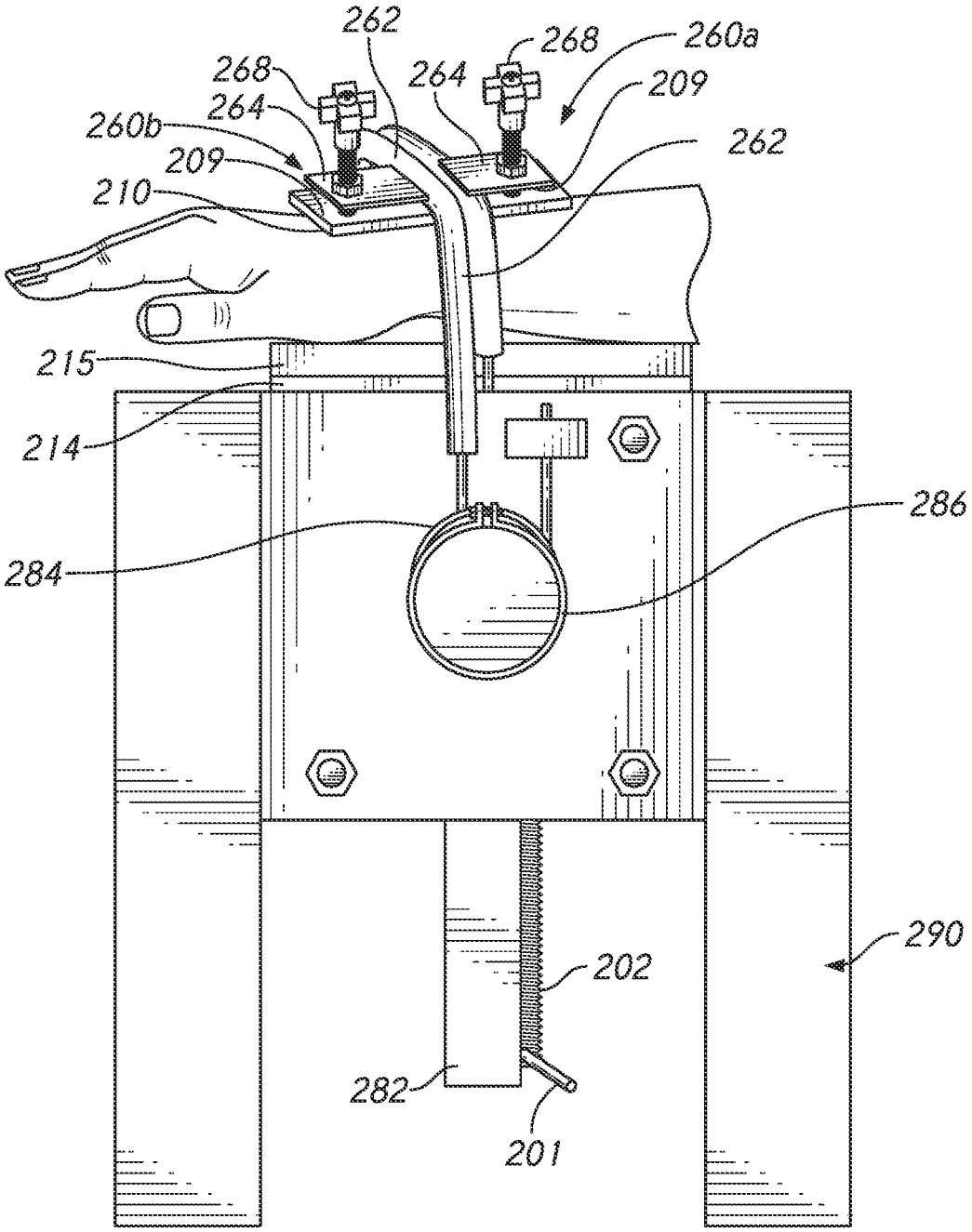
FIG. 14 is an elevation view the medical device shown in FIG. 12 with the arms in an engaged position.
Figure 15:
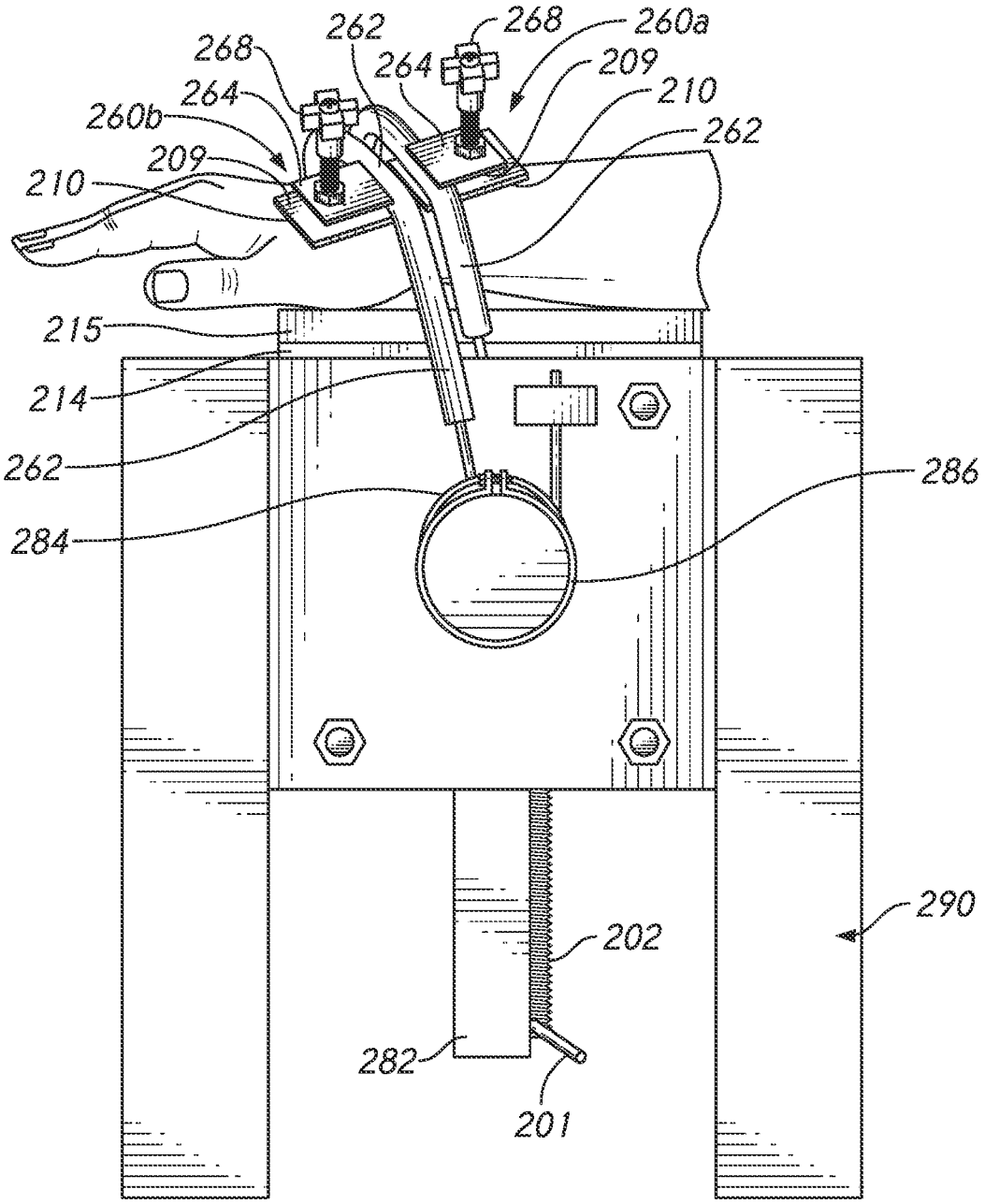
FIG. 15 is an elevation view the medical device shown in FIG. 12 when the stretching mechanism is engaged.

The medical device 300 may also include one or more contact portions 260*a*, 260*b* for contacting the user's forearm, for example the posterior side of the user's forearm. As shown in FIGS. 14 and 15, the medical device 300 may include two contact portions 260*a*, 260*b* adapted to transfer the vertical and non-vertical forces to the underlying tissue. The one or more contact portions may include a first contact portion 260*a* to contact the user's forearm at a first location and a second contact portion 260*b* to contact the user's forearm at a second location, different from the first location. The two contact portions 260*a*, 260*b* may be adjusted from a disengaged position (FIG. 13) to an engaged position (FIGS. 14 and 15) such that the contact portions 260*a*, 260*b* can be properly positioned. For example, a first contact portion 260*a* may be positioned over the user's radius and/or ulna bones and a second contact portion 260*b* may be positioned over the user's carpal and/or metacarpal bones. Each contact portion 260*a*, 260*b* may include a contact plate 209 and/or a skin contact pad 210 adapted for patient comfort when engaging the skin contact plate 209. Each contact portion 260*a*, 260*b* may interface with a corresponding arm 262 that may be rotated from the disengaged position to the engaged position. Each contact portion 260*a*, 260*b* may include a reinforcement member 268 attached to the contact plate 209 by a reinforcement plate 264 to reinforce the contact portions 260*a*, 260*b* against the user's forearm.

The medical device 300 may include one or more compressive force mechanisms 240 for applying a compressive force to the user's forearm at the one or more contact portions 260*a*, 260*b* in a generally anterior-posterior direction. As shown in FIG. 12, the medical device 300 includes a single compressive force mechanism 240 for both contact portions 260*a*, 260*b*. The compressive force mechanism 240 may include an actuator 201 adapted to move the resting portion 230 toward the contact portions 260*a*, 260*b* when the contact portions 260*a*, 260*b* are in the engaged position. The compressive force mechanism 240 may include a gauge 206, such as an algometer or a load cell. The compressive force mechanism 240 may also include one or more features between the actuator 201 and the gauge 206 such that the actuator 201 indirectly interfaces with the gauge 206. The amount of force being applied may vary depending on the patient, for example depending on the amount of adipose tissue present.

As shown in FIG. 12, the actuator 201 may be a knob that drives a threaded rod 202, received by a rod receptor 203 of the static plate 205. The threaded rod 202 transfers the compressive force to the base plate 207. The base plate 207 is movable along rails 282 using sliding cams 272. The compressive force is transferred from the base plate 207 to the transfer block 274, which transfers the compressive force to sliding frame 278 and the resting portion 230. The sliding frame 278 is slidable along rails 282 using sliding cams 280. The compressive force mechanism 240 may also include a gauge 206, such as an algometer or a load cell. The gauge 206 may be secured to the base plate 207 using one or more fasteners 276. Although FIG. 12 illustrates a particular compressive force mechanism 240, any one of the features described above could be rearranged, removed, or substituted or additional features could be added. For example, the compressive force mechanism 240 may not include the gauge 206. Instead, the therapist may rely on the patient's opinion about the pressure.

The medical device 300 can also include a stretching mechanism 250 configured to apply opposing forces to the first and second contact portions 260*a*, 260*b* to stretch the user's underlying tissue. The stretching mechanism 250 may include the rotating arms 262. The rotating arms 262 may apply the opposing forces to the first and second contact portions 260*a*, 260*b*. Each end of the rotating arms 262 may be secured to opposing sides of the device frame 290 via one or more elastic members 284, such as one or more torsion springs. As shown in FIG. 12, each end of the rotating arms 262 is secured, e.g., welded, to the device frame 290 by a torsion spring 284 and/or retention spring 286. The torsion springs generate a radial force to cause the stretching mechanism 250 to stretch the user's underlying tissue. The stretching mechanism 250 may also include a locking mechanism, for example a set of levers forming locking pliers, to hold the arms 262 together and allow for slow separation of the arms 262 after the compressive force mechanism 240 has been engaged.

In use, the arms 262 may be rotated from a disengaged position (FIG. 13) to an engaged position in which the contact portions 260*a*, 260*b* are positioned over the resting portion 230. The arms 262 may be locked in place, for example with a set of levers forming locking pliers. The user may then place their forearm on the resting portion 230 (FIG. 14). The actuator 201 may drive the compressive force mechanism 240 until a comfortable pressure is felt by the patient between the contact portions 260*a*, 260*b* and the resting portion 230. The force is typically between 0 to 200 lbf or between 0 to 150 lbf. The reinforcement members 268 may be engaged to prevent the arms 262 from slipping. The arms 262 could be released, allowing the arms 262 to slowly widen in opposing directions and stretch the tissue on the posterior side of the wrist (FIG. 15). The contact portions 260*a*, 260*b* do not spread significantly. When forces of up to 200 lbf are applied to the contact portions 260*a*, 260*b*, the contact portions 260*a*, 260*b* are configured to move no more than 3 inches, no more than 2 inches, no more than 1 inch, no more than 0.5 inch, or not at all. The tissue is stretched for 0 to 30 minutes and then the compressive force mechanism 240 is disengaged from the patient.

FIGS. 16 to 21 illustrate a medical device 400 for treating carpal tunnel and DeQuervain's syndromes, which may include any feature of the other embodiments described herein. The medical device 400 includes a resting portion 330 for receiving a user's forearm, one or more contact portions 360*a*, 360*b* for contacting the user's forearm opposite the resting portion 330, a compressive force mechanism 340, and/or a stretching mechanism 350 configured to stretch the user's underlying tissue. The medical device 300 also includes a device frame 390 for supporting the compressive force mechanism 340 and/or the stretching mechanism 350.

Figure 16:
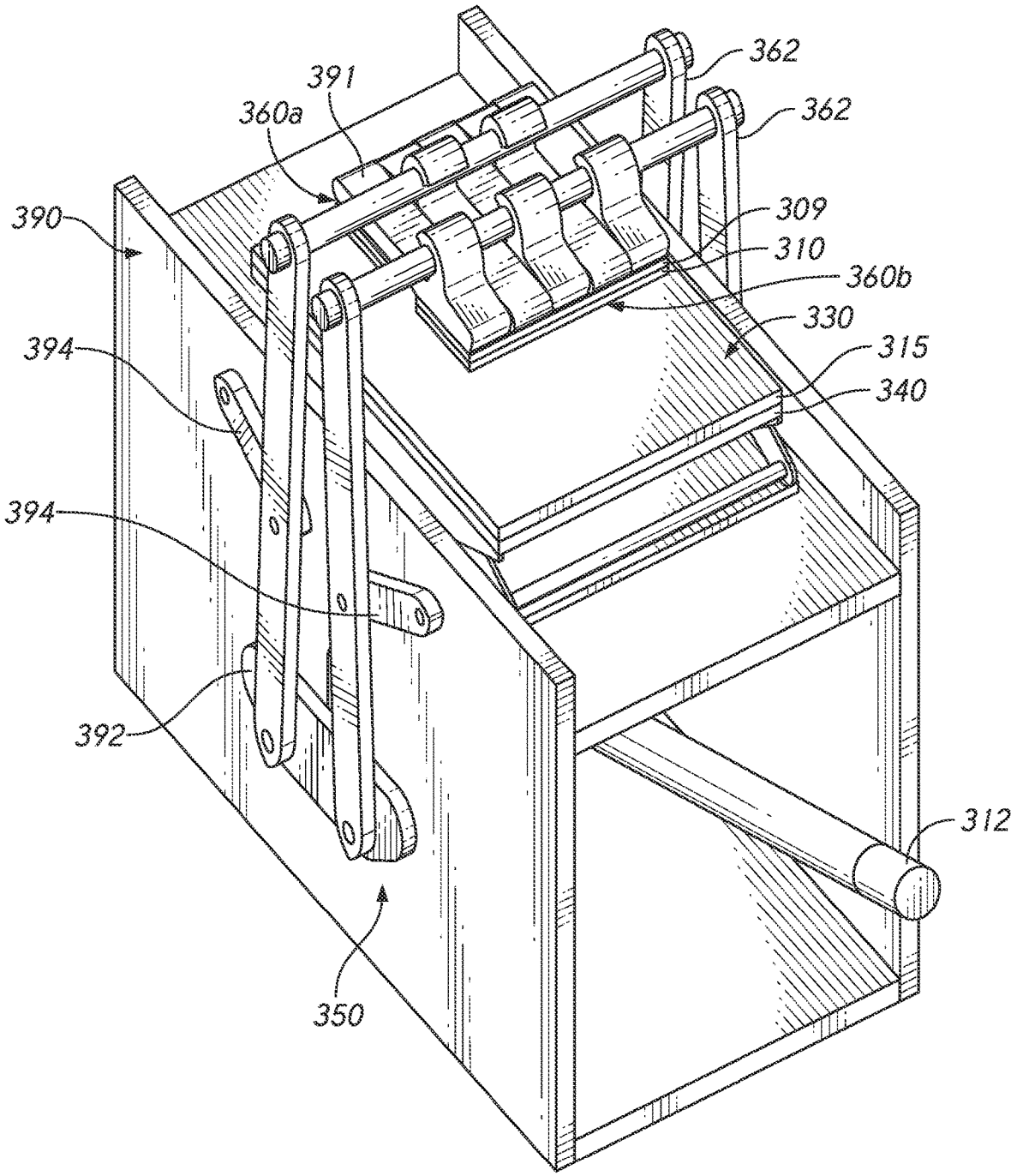
FIG. 16 is a perspective view of yet another embodiment of the medical device.

As shown in FIG. 16, the resting portion 330 may include a forearm pad 315. The resting portion 330 may be positioned closer to an upper end of the device 400 than a lower end of the device 400. The resting portion 330 may define a flat surface adapted to support the forearm of the user. However, the resting portion 330 may take on any configuration suitable for the patient to rest their forearm during treatment. For example, the resting portion 330 may provide an arcuate surface for the user to rest their forearm.

The medical device 400 may also include one or more contact portions 360*a*, 360*b* for contacting the user's forearm, for example the posterior side of the user's forearm. As shown in FIG. 16, the medical device 400 includes two contact portions 360*a*, 360*b* adapted to transfer the vertical and non-vertical forces to the underlying tissue. The one or more contact portions may include a first contact portion 360*a* to contact the user's forearm at a first location and a second contact portion 360*b* to contact the user's forearm at a second location, different from the first location. The first contact portion 360*a* may be positioned over the user's radius and/or ulna bones and the second contact portion 360*b* may be positioned over the user's carpal and/or metacarpal bones. Each contact portion 360*a*, 360*b* may include a contact plate 309 and/or a skin contact pad 310 adapted for patient comfort when engaging the skin contact plate 309. Each contact portion 360*a*, 360*b* may interface with a corresponding arm 362, for example with an adaptor 391 (see FIG. 19).

The medical device 400 may include one or more compressive force mechanisms 340 for applying a compressive force to the user's forearm at the one or more contact portions 360*a*, 360*b* in a generally anterior-posterior direction. As shown in FIG. 16, the medical device 400 includes a single compressive force mechanism 340 for both contact portions 360*a*, 360*b*. The compressive force mechanism 340 may include an actuator adapted to move the resting portion 330 toward the contact portions 360*a*, 360*b*. The compressive force mechanism 340 may include a scissor mechanism and/or a spring mechanism. Using the actuator, the user may adjust the position of the resting portion 330 and apply compression to the user's forearm. The amount of force being applied may vary depending on the patient, for example depending on the amount of adipose tissue present.

The medical device 400 may also include a stretching mechanism 350 configured to apply opposing forces to the first and second contact portions 360*a*, 360*b* to stretch the user's underlying tissue. The stretching mechanism 350 may include the rotating arms 362. The rotating arms 362 may apply the opposing forces to the first and second contact portions 360*a*, 360*b*. Each end of the rotating arms 362 may be secured to opposing sides of the device frame 390.

Figure 20:
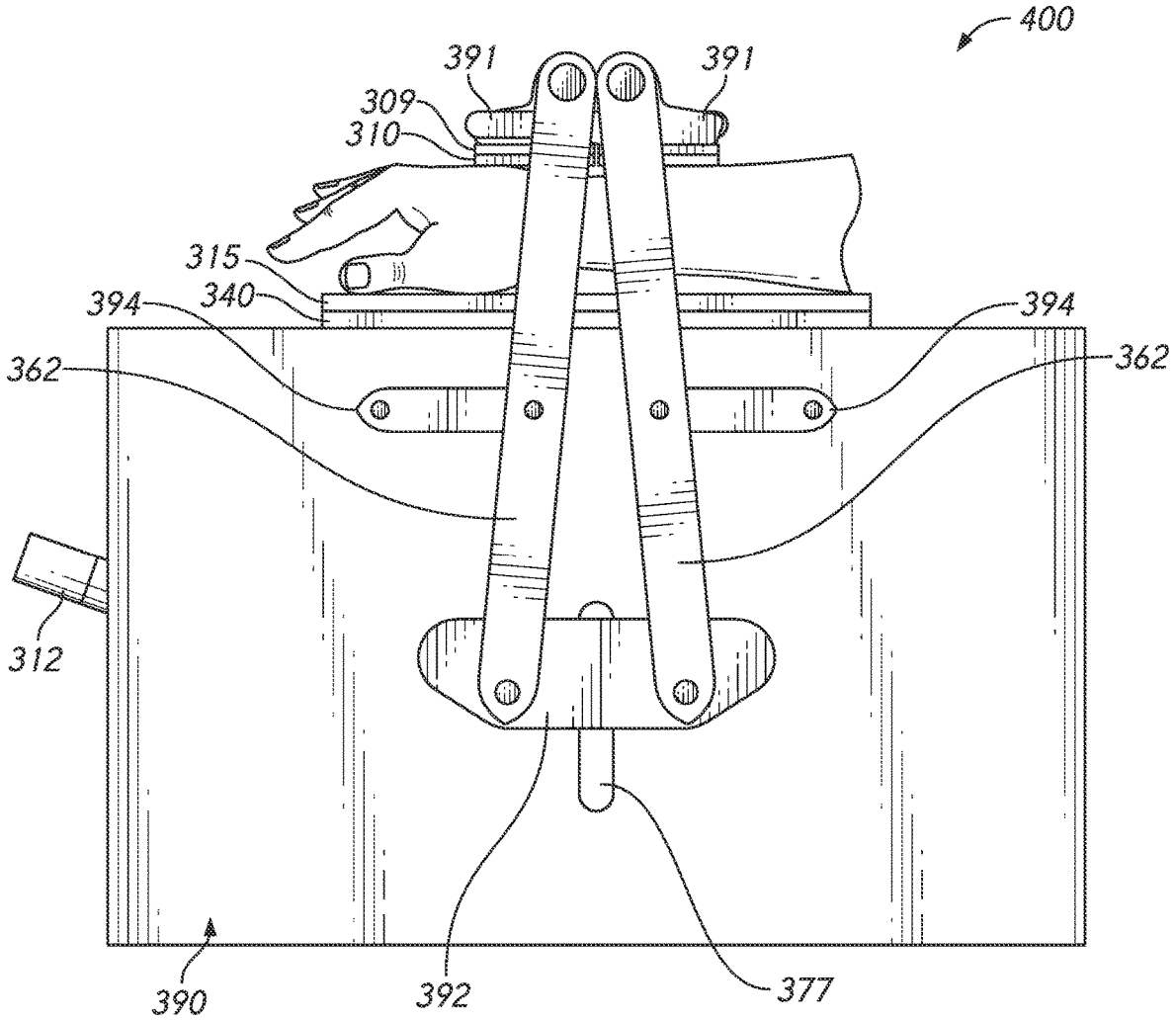
FIG. 20 is an elevation view of the medical device shown in FIG. 16 when the stretching mechanism is disengaged.
Figure 21:
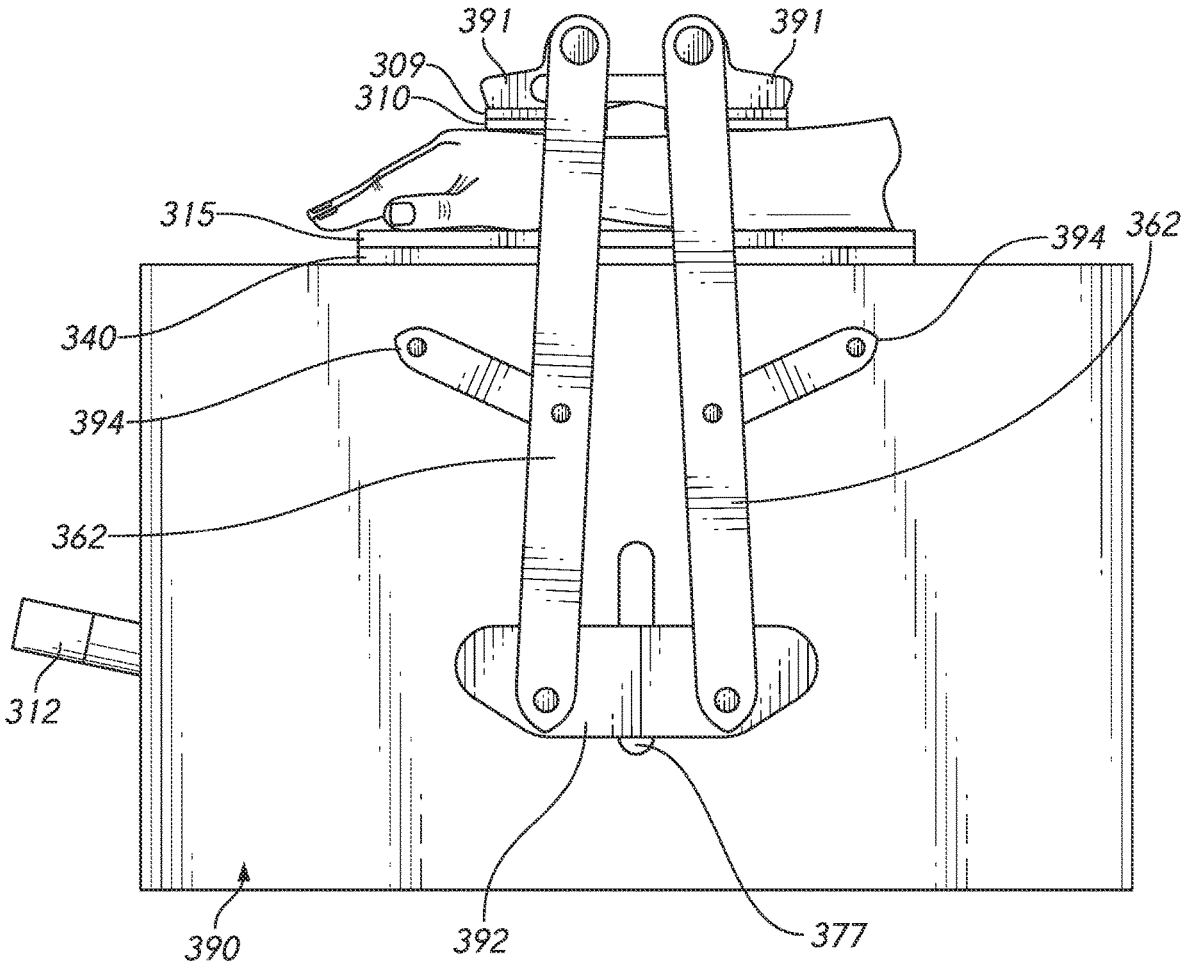
FIG. 21 is an elevation view of the medical device shown in FIG. 16 when the stretching mechanism is engaged.

In the medical device 400, the stretching mechanism 350 may apply both compressive forces in a generally vertical or anterior-posterior direction and opposing forces in a non-vertical or generally proximal-distal direction. These compressive forces may be in addition to or in place of the compressive force mechanism 340. As shown in FIG. 16, each end of the rotating arms 362 is secured to the device frame 390 by one or more arm guides, for example a sliding cam 392 and/or a rotating cam 394. One or more sliding cams 392 may control the vertical movement (or compressive forces) of the contact portions 360*a*, 360*b*, while one or more rotating cams 394 control the non-vertical movement (or opposing forces) of the contact portions 360*a*, 360*b*. As shown in FIGS. 20 and 21, the sliding cams 392 slide within elongate slots 377 in the device frame 390.

Figure 18:
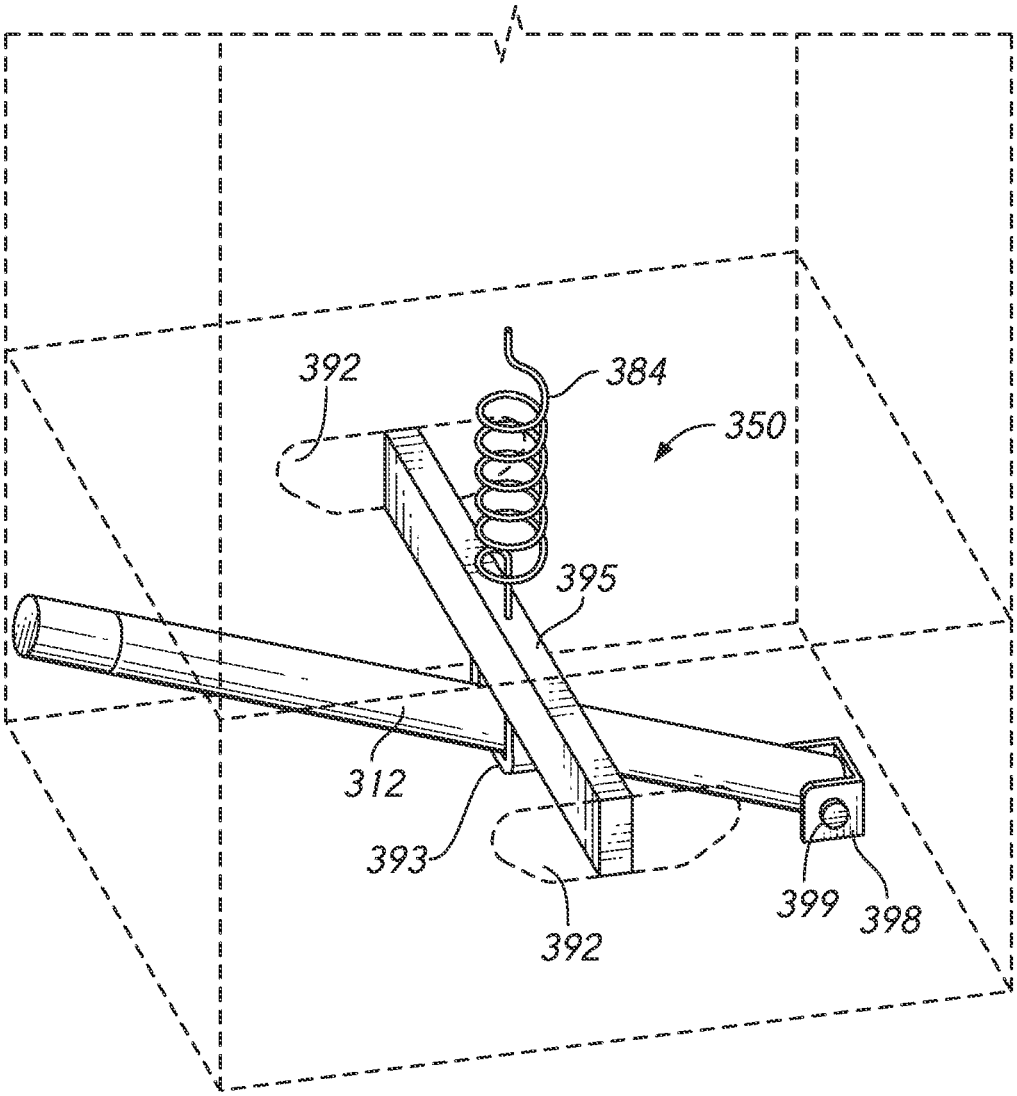
FIG. 18 is a partial view of the stretching mechanism of the medical device shown in FIG. 16.
Figure 19:
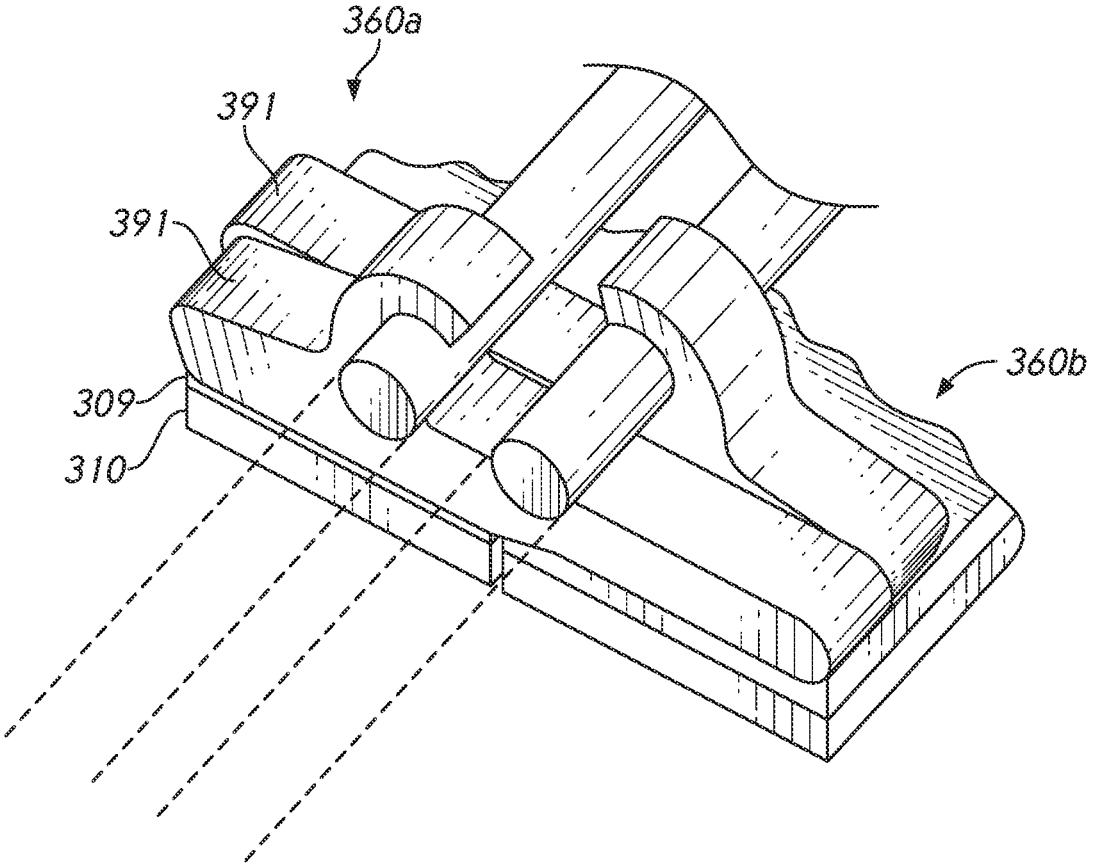
FIG. 19 is a partial view of the contact portions of the medical device shown in FIG. 16.

As shown in FIG. 18, the stretching mechanism 350 may include a spring mechanism including an actuator 312 interfacing with a spring 384. As illustrated, the actuator 312 is a lever indirectly interfacing with the spring 384 by an adaptor 393 on a cross bar 395. The cross bar 395 extends between the sliding cams 392. As the actuator 312 is pulled down, the arms 362 move the contact portions 360*a*, 360*b* downward (FIG. 20). As the arms 362 continue to move through their range of motion, the rotating cams 394 allow the contact portions 360*a*, 360*b* to begin stretching the underlying tissue (FIG. 21). The stretching mechanism 350 may also include a gauge, such as an algometer or a load cell, to show the total amount of compression force.

When the stretching mechanism 350 is engaged, the compressive force is typically between 0 to 200 lbf. As the contact portions 360*a*, 360*b* begin stretching the underlying tissue, the contact portions 360*a*, 360*b* do not spread significantly. When forces of up to 200 lbf are applied to the contact portions 360*a*, 360*b*, the contact portions 360*a*, 360*b* are configured to move no more than 3 inches, no more than 2 inches, no more than 1 inch, no more than 0.5 inch, or not at all. The tissue is stretched for 0 to 30 minutes and then the stretching mechanism 350 is released.

Figure 17:
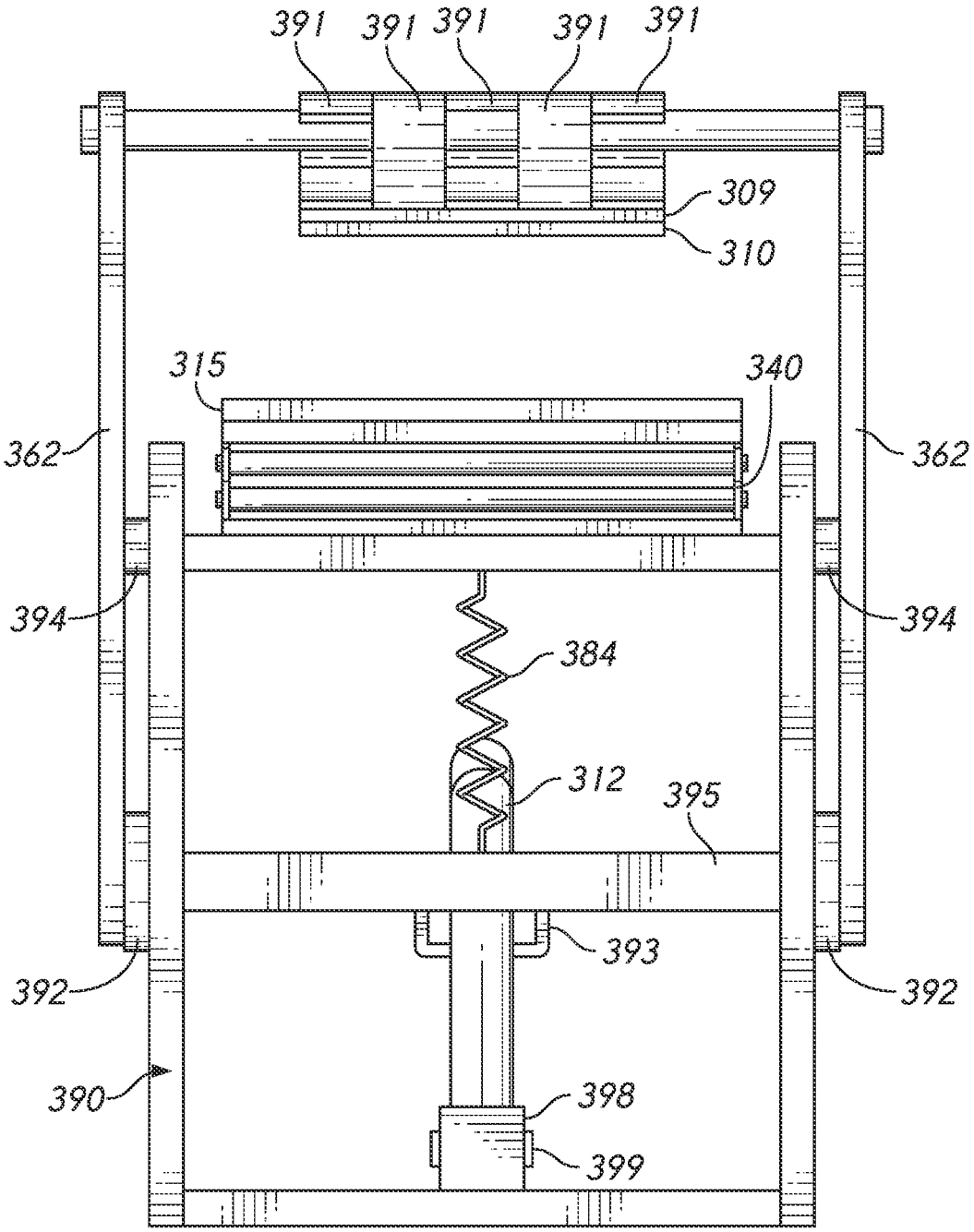
FIG. 17 is an elevation view of the medical device shown in FIG. 16.

As shown in FIG. 17, the stretching mechanism 350 may also include a locking mechanism 398 to lock the arms 362 in place. As the actuator 312 is pulled down, the locking mechanism 398, for example a ratchet mechanism, locks the arms 362 in place. The arms 362 may be released by activating the release mechanism 399. When the arms 362 are released, the spring 384 pulls the cross bar 395 upward, causing the sliding cams 392 to slide upward and release contact portions 360*a*, 360*b*.

Figure 22:
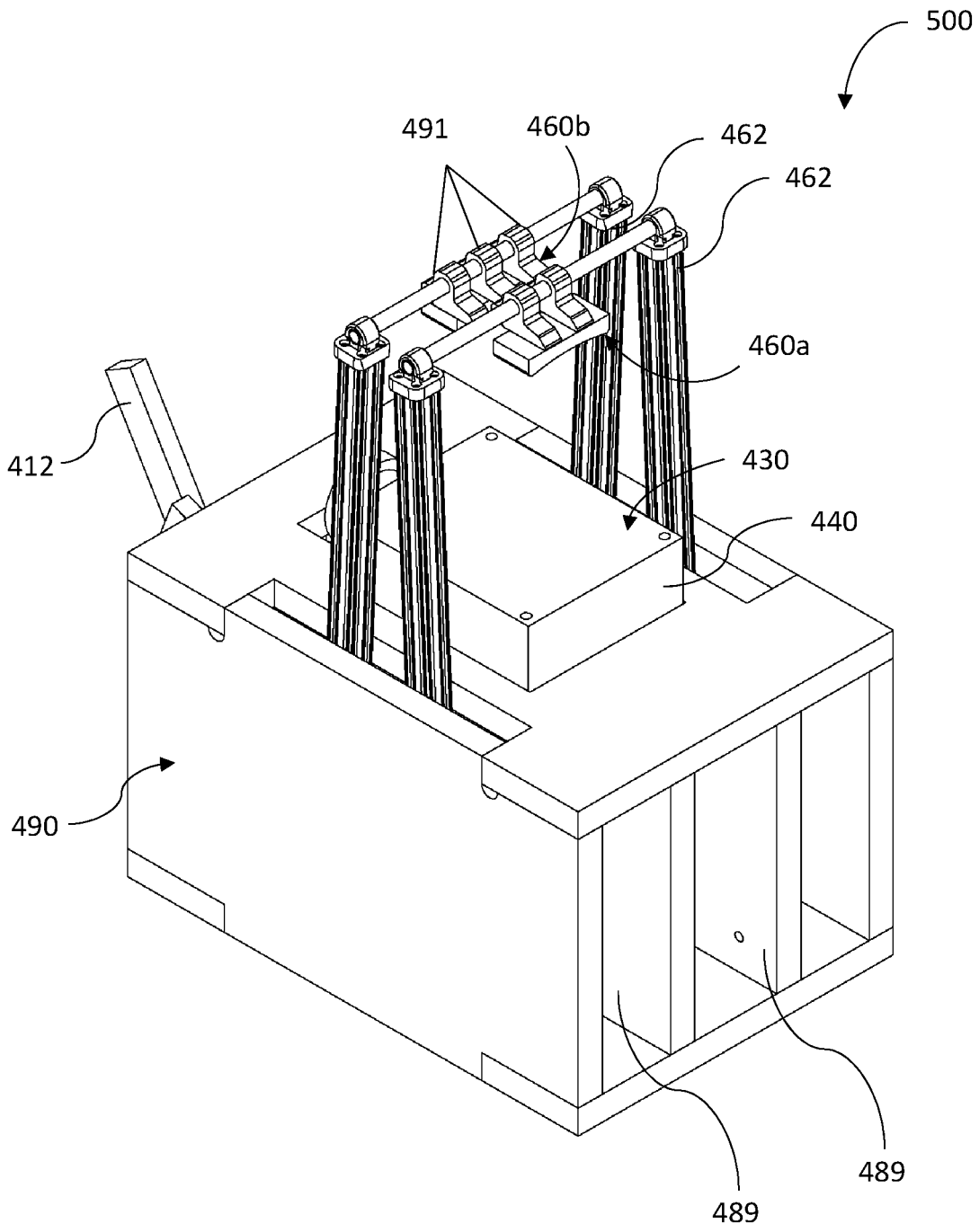
FIG. 22 is a perspective view of another medical device.
Figure 23:
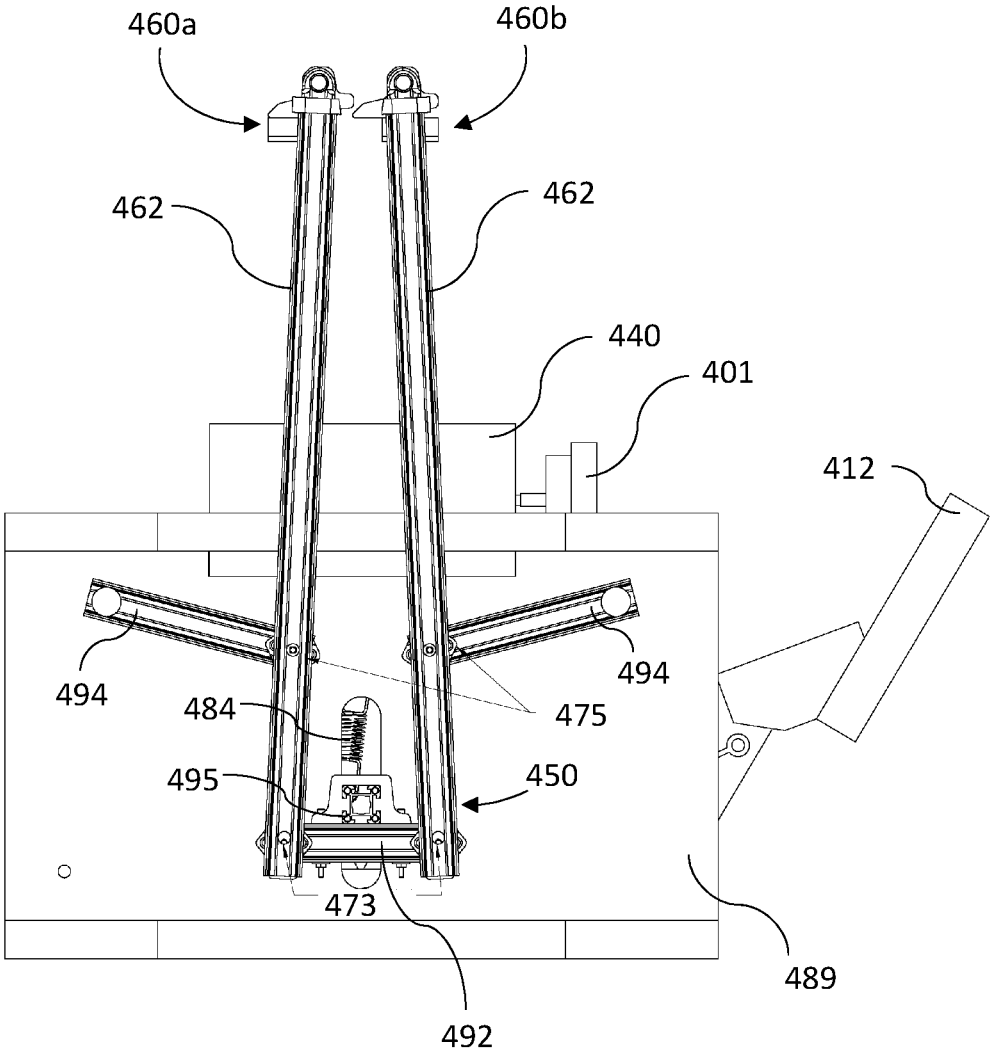
FIG. 23 is an elevation view of the medical device shown in FIG. 22.
Figure 24:
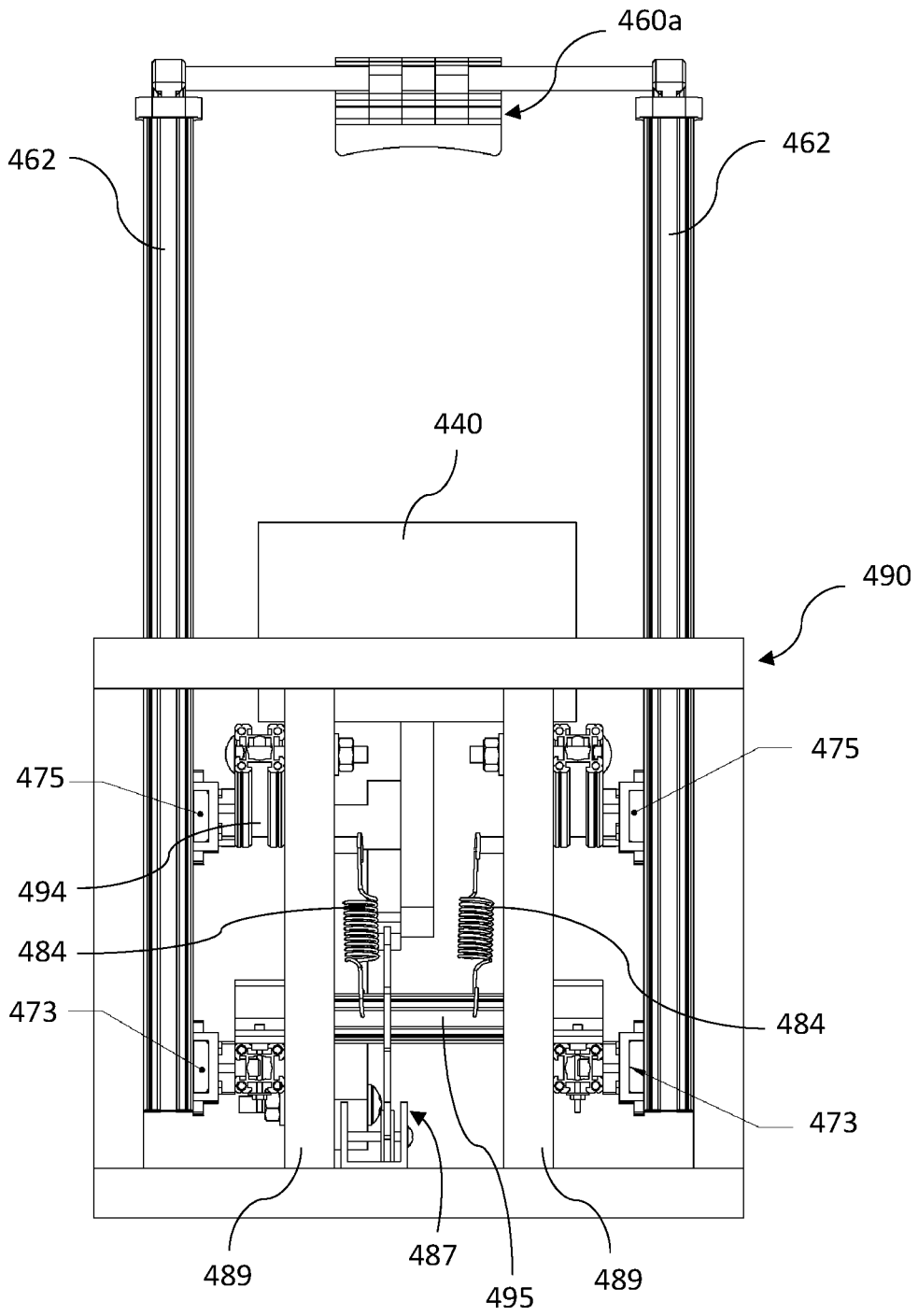
FIG. 24 is a different elevation view of the medical device shown in FIG. 22.

FIGS. 22 to 24 illustrate a medical device 500 for treating carpal tunnel and DeQuervain's syndromes, which may include any feature of the other embodiments described herein. The medical device 500 includes a resting portion 430 for receiving a user's forearm, one or more contact portions 460*a*, 460*b* for contacting the user's forearm opposite the resting portion 430, a compressive force mechanism 440, and/or a stretching mechanism 450 configured to stretch the user's underlying tissue. The medical device 500 also includes a device frame 490 for supporting the compressive force mechanism 440 and/or the stretching mechanism 450.

The resting portion 430 may include a forearm pad. The resting portion 430 may be positioned closer to an upper end of the device 500 than a lower end of the device 500. The resting portion 430 may define a flat surface adapted to support the forearm of the user. However, the resting portion 430 may take on any configuration suitable for the patient to rest their forearm during treatment. For example, the resting portion 430 may provide an arcuate surface for the user to rest their forearm.

The medical device 500 may also include one or more contact portions 460*a*, 460*b* for contacting the user's forearm, for example the posterior side of the user's forearm. As shown in FIG. 22, the medical device 500 may include two contact portions 460*a*, 460*b* adapted to transfer the vertical and non-vertical forces to the underlying tissue. The one or more contact portions may include a first contact portion 460*a* to contact the user's forearm at a first location and a second contact portion 460*b* to contact the user's forearm at a second location, different from the first location. The first contact portion 460*a* may be positioned over the user's radius and/or ulna bones and the second contact portion 460*b* may be positioned over the user's carpal and/or metacarpal bones. Each contact portion 460*a*, 460*b* may include a contact plate and/or a skin contact pad adapted for patient comfort when engaging the skin contact plate 309. Each contact portion 460*a*, 460*b* may interface with a corresponding arm 462, for example with an adaptor 491.

The medical device 500 may include one or more compressive force mechanisms 440 for applying a compressive force to the user's forearm at the one or more contact portions 460*a*, 460*b* in a generally anterior-posterior direction. As shown in FIG. 22, the medical device 500 includes a single compressive force mechanism 440 for both contact portions 460*a*, 460*b*. The compressive force mechanism 440 may include an actuator 401 adapted to move the resting portion 430 toward the contact portions 460*a*, 460*b*. The compressive force mechanism 440 may also include a scissor mechanism and/or a spring mechanism. Using the actuator, the user may adjust the position of the resting portion 430 and apply compression to the user's forearm. The amount of force being applied may vary depending on the patient, for example depending on the amount of adipose tissue present.

The medical device 500 can also include a stretching mechanism 450 configured to apply opposing forces to the first and second contact portions 460*a*, 460*b* to stretch the user's underlying tissue. The stretching mechanism 450 may include the rotating arms 462. The rotating arms 462 may apply the opposing forces to the first and second contact portions 460*a*, 460*b*. Each end of the rotating arms 462 may be secured to opposing sides of the device frame 490.

In the medical device 500, the stretching mechanism 450 may apply both compressive forces in a generally vertical or anterior-posterior direction and opposing forces in a non-vertical or generally proximal-distal direction. These compressive forces may be in addition to or in place of the compressive force mechanism 440.

FIG. 23 shows the medical device 500 with an exterior wall removed such that an interior wall 489 of the device frame 490 and the stretching mechanism 450 may be seen. As shown in FIG. 23, each end of the rotating arms 462 is secured to the device frame 490 by one or more arm guides, for example a sliding cam 492 and/or a rotating cam 494. One or more sliding cams 492 may control the vertical movement (or compressive forces) of the contact portions 460*a*, 460*b*, while one or more rotating cams 494 control the non-vertical movement (or opposing forces) of the contact portions 460*a*, 460*b*. The sliding cams 492 slide within elongate slots 477 in the interior wall 489. Each rotating arm 492 may be secured to a rotating cam 494 at a first joint 475 and secured to a sliding cam 492 at a second joint 473 that is displaced from the first joint 475.

Figure 25:
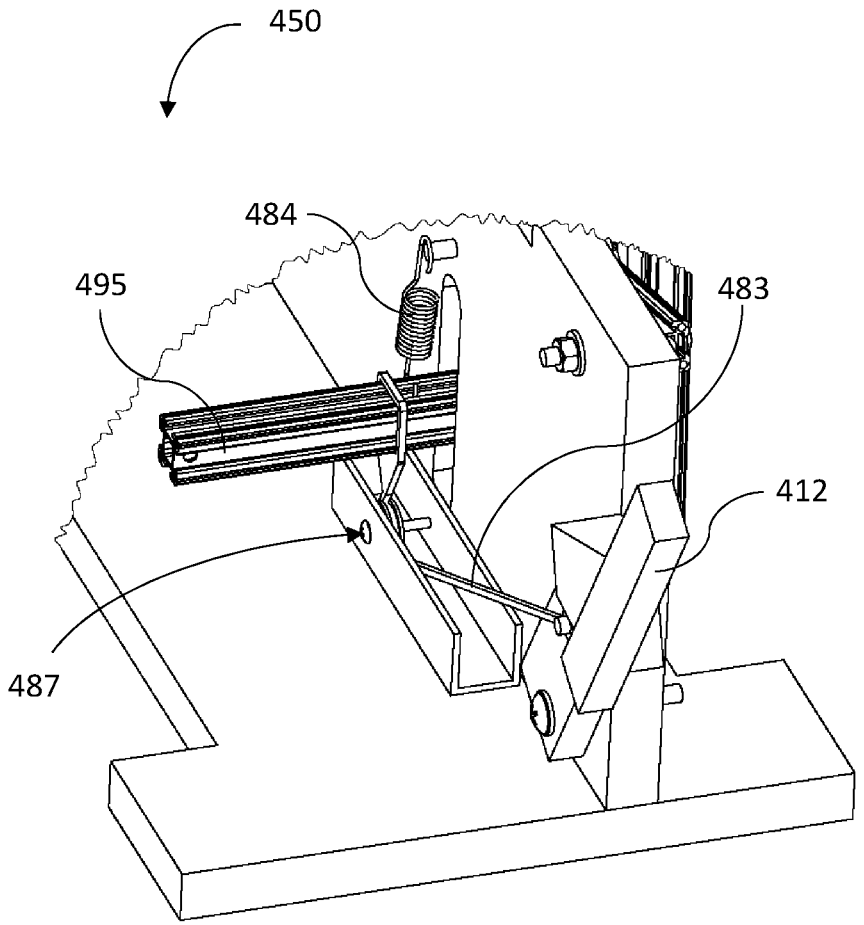
FIG. 25 is a detail view of the stretching mechanism of the medical device shown in FIG. 22.

As shown in FIGS. 24 and 25, the stretching mechanism 450 may also include a pulley system including an actuator 412 directly or indirectly interfacing with a pulley 487. For example, the actuator 412 may be a lever that interfaces with the pulley 487 using a cable 483. The pulley 487 also interfaces with the cross bar 495. As the actuator 412 is pulled down, the cross bar 495 pulls the sliding cams 492 downward, causing the arms 462 move the contact portions 460*a*, 460*b* downward. As the arms 462 continue to move through their range of motion, the rotating cams 494 allow the contact portions 460*a*, 460*b* to begin stretching the underlying tissue. The stretching mechanism 450 may also include a gauge underneath the resting portion 430, such as an algometer or a load cell, to show the total amount of compression force.

The pulley system may also include a locking mechanism to lock the arms 462 in place. When the actuator 412 reaches the end of its range, the actuator 412 may lock in place, for example using a flipping mechanism, to lock the arms 462 in place. When the arms 462 are released, the spring 484 brings the cross bar 395 upward, causing the sliding cams 492 to slide upward and release contact portions 460*a*, 460*b*.

When the stretching mechanism 450 is engaged, the compressive force is typically between 0 to 200 lbf. As the contact portions 460*a*, 460*b* begin stretching the underlying tissue, the contact portions 460*a*, 460*b* do not spread significantly. When forces of up to 200 lbf are applied to the contact portions 460*a*, 460*b*, the contact portions 460*a*, 460*b* are configured to move no more than 3 inches, no more than 2 inches, no more than 1 inch, no more than 0.5 inch, or not at all. The tissue is stretched for 0 to 30 minutes and then the stretching mechanism 350 is released. The stretching mechanism 350 may also include a spring mechanism to facilitate the return of the arms 462 to their starting position.

TERMINOLOGY

Although the devices and methods have been described herein in connection with treating carpal tunnel or DeQuervain's syndromes in a user's forearm, the devices and methods described herein can be used to release myofascial restrictions in any portion of the user's body. For example, in some embodiments, the resting portion of the medical devices described herein can be adapted to receive the user's upper arm or a portion of the user's leg.

As used herein, the relative terms "anterior," "posterior," "proximal," and "distal" shall be defined from the perspective of the user's hand. Thus, anterior refers to the direction of the user's palm and posterior refers to the opposite side of the user's hand. Also, distal refers to the direction of the user's fingertips and proximal refers to the direction of the user's elbow.

Although certain embodiments and examples have been described herein, it will be understood by those skilled in the art that many aspects of the delivery systems shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements, and/or states. Thus, such conditional language is not generally intended to imply that features, elements, blocks, and/or states are in any way required for one or more embodiments or that one or more embodiments necessarily include logic for deciding, with or without author input or prompting, whether these features, elements and/or states are included or are to be performed in any particular embodiment.

The ranges disclosed herein also encompass any and all overlap, sub-ranges, and combinations thereof. Language such as "up to," "at least," "greater than," "less than," "between," and the like includes the number recited. Phrases preceded by a term such as "generally" include the recited phrase and should be interpreted based on the circumstances (e.g., as much as reasonably possible under the circumstances). For example, "generally vertical" includes "vertical."

The following is claimed:

1. A device for treating carpal tunnel syndrome or DeQuervain's syndrome, the device comprising:

a resting portion for receiving a side of a user's forearm;

a first contact portion configured to contact an opposite side of the user's forearm and apply a compressive force to the user's forearm at a first location; and a second contact portion configured to contact the opposite side of the user's forearm, the second contact portion configured to apply a compressive force to the user's forearm at a second location different than the first location;

the device having a first configuration in which the first contact portion and the second contact portion are in contact with the user's forearm;

the device having a second configuration in which the first contact portion and the second contact portion are moved away from the first configuration in opposite directions to apply opposing forces at the first location and the second location to stretch the user's tissue.

2. The device of claim 1, further comprising a stretching mechanism configured to apply the opposing forces at the first location and second location.

3. The device of claim 1, wherein the first contact portion and the second contact portion are configured to move no more than 3 inches relative to each other when compressive forces of up to 200 lbf are applied.

4. The device of claim 1, wherein the compressive forces being applied to the user's forearm by the first contact portion and the second contact portion are adjustable.

5. The device of claim 1, further comprising one or more gauges configured to transfer the compressive forces to the first and second contact portions.

6. The device of claim 1, further comprising an actuator configured to adjust the opposing forces applied to the first and second contact portions.

7. The device of claim 6, wherein the first and second contact portions are positioned between the actuator and the resting portion.

8. The device of claim 2, wherein the stretching mechanism comprises a double ended screw.

9. The device of claim 2, wherein the stretching mechanism comprises a compression spring.

10. The device of claim 2, wherein the stretching mechanism comprises a mechanical linkage.

11. The device of claim 2, wherein the stretching mechanism comprises a torsion spring.

12. The device of claim 2, wherein the stretching mechanism comprises a scissor mechanism.

13. The device of claim 1, wherein a distance between the first and second contact portions and the resting portion is adjustable.

14. The device of claim 1, further comprising a locking mechanism configured to lock a position of the first and second contact portions relative to the resting portion.

15. The device of claim 2, wherein the stretching mechanism is configured to apply the opposing forces in a direction generally perpendicular to the compressive forces applied by the first and second contact portions.

16. A device for treating carpal tunnel syndrome or DeQuervain's syndrome, the device comprising: a resting portion for receiving a side of a user's forearm; a first contact portion configured to contact an opposite side of the user's forearm and apply a compressive force to the user's forearm at a first location; and a second contact portion configured to contact the opposite side of the user's forearm, the second contact portion configured to apply a compressive force to the user's forearm at a second location different than the first location; the device having a first configuration in which the first contact portion and the second contact portion do not contact the user's forearm; the device having a second configuration in which the first contact portion and the second contact portion apply the compressive forces to the user's forearm at the first location and the second location and the first contact portion and the second contact portion move in opposite directions to apply opposing forces to the first contact portion and the second contact portion to stretch the user's tissue, wherein the opposing forces are in a direction generally perpendicular to the compressive force.

17. The device of claim 16, further comprising a stretching mechanism configured to apply the compressive forces and the opposing forces.

18. The device of claim 16, further comprising a compressive force mechanism configured to move the resting portion toward the first and second contact portions.

19. The device of claim 16, further comprising a release mechanism configured to release a position of the first and second contact portions.

20. The device of claim 16, further comprising a locking mechanism configured to lock a position of the first and second contact portions relative to the resting portion.

21. The device of claim 17, wherein the stretching mechanism is configured to move the first and second contact portions in opposite directions.

22. A method for treating a user, the method comprising:

positioning a side of the user's forearm on a resting portion of a device;

contacting a first contact portion of the device with an opposite side of the user's forearm over a radius and/or an ulna bone, contacting a second contact portion of the device with the opposite side of the user's forearm over carpal and/or metacarpal bones at a second location different from the first location;

applying a compressive force to the user's forearm using the first and second contact portions;

moving the first contact portion in a first direction and moving the second contact portion in a second direction to apply opposing forces to the first contact portion and the second contact portion.

23. The method of claim 22, wherein applying the opposing forces comprises applying the opposing forces in a direction generally perpendicular to the compressive force applied by the first and second contact portions.

* * * * *